US011148276B2

(12) United States Patent
Snook et al.

(10) Patent No.: US 11,148,276 B2
(45) Date of Patent: Oct. 19, 2021

(54) MULTI-BIT SCREWDRIVER

(71) Applicant: Wheelfloat, Inc., Southlake, TX (US)

(72) Inventors: Jonathan D. Snook, Southlake, TX (US); Thomas G. Fulbright, Keller, TX (US)

(73) Assignee: Wheelfloat, Inc., Southlake, TX (US)

( * ) Notice: Subject to any disclaimer, the term of this patent is extended or adjusted under 35 U.S.C. 154(b) by 322 days.

(21) Appl. No.: 16/134,808

(22) Filed: Sep. 18, 2018

(65) Prior Publication Data

US 2019/0047134 A1 Feb. 14, 2019

Related U.S. Application Data

(63) Continuation-in-part of application No. 15/134,139, filed on Apr. 20, 2016, now Pat. No. 10,076,835.

(60) Provisional application No. 62/150,765, filed on Apr. 21, 2015.

(51) Int. Cl.

| | |
|---|---|
| ***B25F 5/02*** | (2006.01) |
| ***B25G 1/08*** | (2006.01) |
| ***B25B 23/00*** | (2006.01) |
| ***B25B 21/00*** | (2006.01) |
| ***B25B 15/04*** | (2006.01) |
| ***B25F 3/00*** | (2006.01) |

(52) U.S. Cl.

CPC ..... *B25F 5/029* (2013.01); *B25B 15/04* (2013.01); *B25B 21/00* (2013.01); *B25B 23/0035* (2013.01); *B25F 3/00* (2013.01); *B25G 1/085* (2013.01)

(58) Field of Classification Search

CPC ..... B25F 5/029

See application file for complete search history.

(56) References Cited

U.S. PATENT DOCUMENTS

| | | | |
|---|---|---|---|
| 728,188 | A | 5/1903 | Barstad |
| 2,629,413 | A | 2/1953 | Stettler |
| 3,006,395 | A | 10/1961 | Dye |
| 3,750,729 | A | 8/1973 | Lemieux |
| 4,372,362 | A | 2/1983 | Ahn |
| 4,716,795 | A | 1/1988 | Corona et al. |
| 4,762,036 | A | 8/1988 | Orlitzky et al. |

(Continued)

FOREIGN PATENT DOCUMENTS

| | | | |
|---|---|---|---|
| CA | 2274503 | A1 | 12/2000 |
| CN | 102791435 | A | 11/2012 |

(Continued)

OTHER PUBLICATIONS

Israel Patent Office, International Search Report, PCT/US2020/063646, dated Mar. 25, 2021.

*Primary Examiner* — Hadi Shakeri

(74) *Attorney, Agent, or Firm* — Jack D. Stone, Jr.; Scheef & Stone, L.L.P.

(57) ABSTRACT

A screwdriver stores in a storage device multiple bits readily selectable for retrieval and use. The storage device includes at least one cartridge defining a cavity for receiving at least one bit. A receiver defines at least one cell for receiving the at least one cartridge, and a passageway extends longitudinally along the center of the receiver to an opening defined in an external surface of the receiver. Springs are employed for biasing the at least one cartridge in a first position in the at least one cell wherein the cavity is not aligned with the passageway, or in a second position in the at least one cell wherein the cavity is aligned with the passageway.

12 Claims, 34 Drawing Sheets

(56) References Cited

U.S. PATENT DOCUMENTS

| | | | |
|---|---|---|---|
| 5,325,745 | A | 7/1994 | Koehler |
| 5,337,637 | A | 8/1994 | Bih-Lien |
| 5,398,946 | A | 3/1995 | Quiring |
| 5,526,721 | A | 6/1996 | Waisvisz |
| 5,673,600 | A | 10/1997 | Yanagi et al. |
| 6,205,893 | B1 | 3/2001 | Sato |
| 6,332,384 | B1 | 12/2001 | Cluthe |
| 6,601,483 | B2 | 8/2003 | Wannop |
| 7,000,509 | B2 | 2/2006 | Shiao |
| 7,021,181 | B1 | 4/2006 | Chi |
| 7,028,593 | B1 | 4/2006 | Lin et al. |
| 7,665,391 | B2 | 2/2010 | Beauchamp |
| 7,757,589 | B2 | 7/2010 | Kielland |
| 8,783,138 | B2 | 7/2014 | Johnson |
| 10,076,835 | B2 | 9/2018 | Snook et al. |
| 10,442,074 | B2 | 10/2019 | Fulbright et al. |
| 2002/0096024 | A1 | 7/2002 | Pao-Hsi |
| 2005/0092144 | A1 | 5/2005 | Shiao |
| 2007/0251358 | A1 | 11/2007 | Grand et al. |
| 2008/0111323 | A1 | 5/2008 | Braunberger |
| 2016/0311092 | A1 | 10/2016 | Fulbright et al. |

FOREIGN PATENT DOCUMENTS

| | | | |
|---|---|---|---|
| CN | 205765859 | U | 12/2016 |
| DE | 9411520 | U1 | 11/1995 |
| EP | 0978356 | A2 | 2/2000 |
| EP | 1381494 | B1 | 5/2007 |

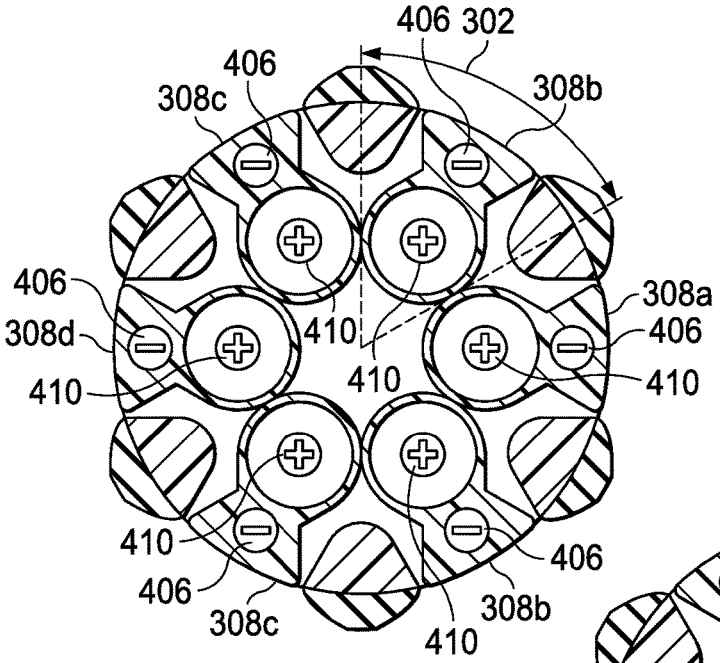
FIG. 8A
FIG. 8B
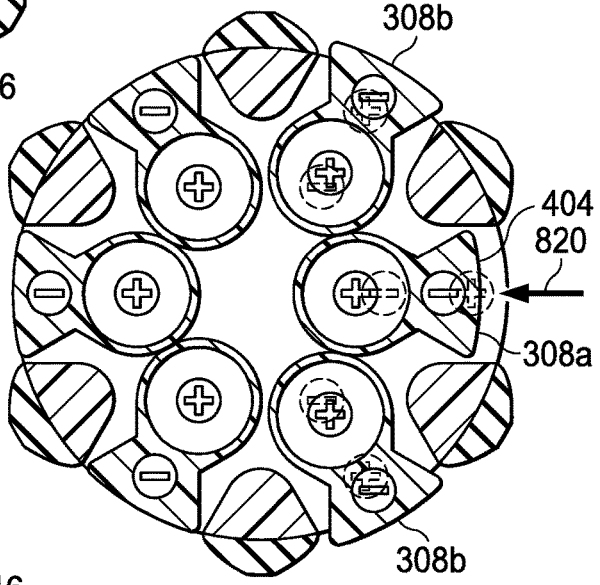
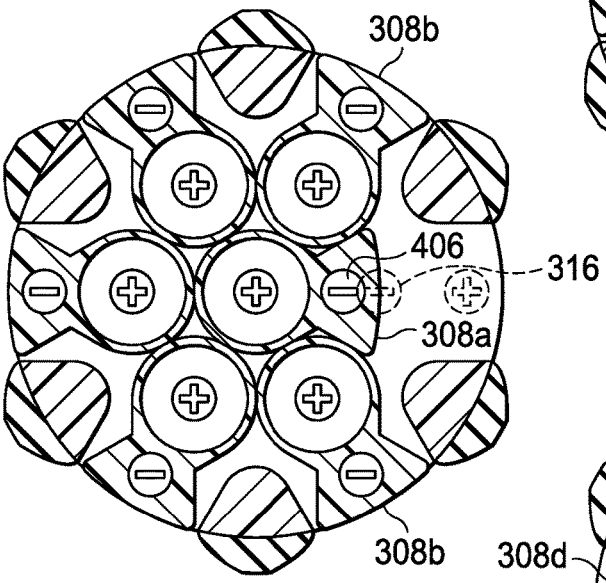
FIG. 8C
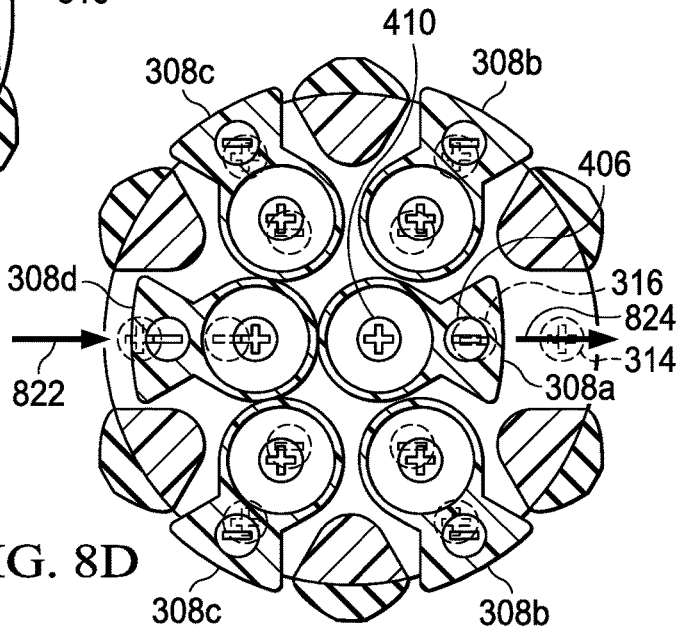
FIG. 8D

MULTI-BIT SCREWDRIVER

CROSS-REFERENCE TO RELATED APPLICATIONS

This application is a continuation-in-part of U.S. Pat. No. 10,076,835, formerly co-pending patent application Ser. No. 15/134,139, filed on Apr. 20, 2016, and issued on Sep. 18, 2018, which patent claims the benefit of U.S. Provisional Application No. 62/150,765, filed Apr. 21, 2015, which patent and application are hereby incorporated herein by reference, in their entirety.

TECHNICAL FIELD

The invention relates generally to a tool and, more particularly, to a screwdriver configured to store multiple bits readily selectable for retrieval and use.

BACKGROUND

It is common to have a large number of small items that must be stored in some manner. Such small items may include, by way of example, but not limitation, artist charcoal/pencils, children's crayons, drill bits, taps (for cutting threads), bobbins for sewing, spices, gauge pins, screwdriver bits, fishing weights, and the like. Often, small items are all stored together in a large bin, but it then becomes difficult to identify and retrieve any particular item. In other instances, a small box or drawer will be devoted to each item, but that often results in an inefficient use of space.

A screwdriver represents a particular case in point wherein a person may need a number of different screwdrivers to perform a task. This is particularly problematic, time consuming, and even dangerous, when such person is working on a ladder and must continually go up and down the ladder to fetch different screwdrivers. For such cases, screwdrivers are available which hold a number of different bits selectable by a user; such screwdrivers are referred to as multi-bit screwdrivers. There are, however, a number of drawbacks associated with "multi-bit" screwdrivers. The most common drawback is that such screwdrivers typically require two hands to change a bit, which can be dangerous when, for example, a user is standing atop a high ladder. Another common drawback is that the number of bits is very limited, such as six or even fewer bits. A still further drawback is that bits can be dropped or lost during handling.

In view of the foregoing, there is a need for a screwdriver with a storage device configured to store multiple bits that are readily selectable for retrieval and use. It would be desirable for the screwdriver to be operable with a single hand, to carry a sufficient number of bits to be useful in a large number of applications, and wherein the bits are secured and loaded within the screwdriver.

SUMMARY

The present invention, accordingly, provides a storage device for managing the storage and retrieval of items for delivery to a point of use. Accordingly, the storage device includes at least one cartridge defining a cavity for receiving at least one storage item. A receiver defines at least one cell for receiving the at least one cartridge, and a passageway extending longitudinally along the center of the receiver to an opening in an external surface of the receiver. In a first embodiment, magnets are secured to the receiver and the at least one cartridge for magnetically biasing the at least one cartridge in a first position in the at least one cell wherein the cavity is not aligned with the passageway, or in a second position in the at least one cell wherein the cavity is aligned with the passageway.

In a second embodiment, one of one or more cartridge springs (cut, e.g., from a sheet of Mylar®) extends through a slot of a respective cartridge of the one or more cartridges, and is positioned and restrained between two spring stops. Each cartridge spring of the one or more cartridge springs is sized to bow between the two spring stops and bias each of the one or more cartridges in a first position in the one or more cells wherein the cavity is not aligned with the passageway, or in a second position in the one or more cells wherein the cavity is aligned with the passageway.

In one application of the invention, the storage device is configured as a portion of a handle in a multi-bit screwdriver having a tubular shaft extending from the handle. The screwdriver is configured for enabling a user to select a bit and pass it through the handle and tubular shaft to an end of the shaft for use in tightening and loosening fasteners, such as screws. A ratchet mechanism is preferably positioned between the handle and the shaft for selectively controlling the direction of rotation in which the handle turns the shaft and bit.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIGS. 8A-8D exemplify various states of cartridges positioned in a handle and taken along line 8-8 of FIG. 3D;

DETAILED DESCRIPTION

Figure 1:
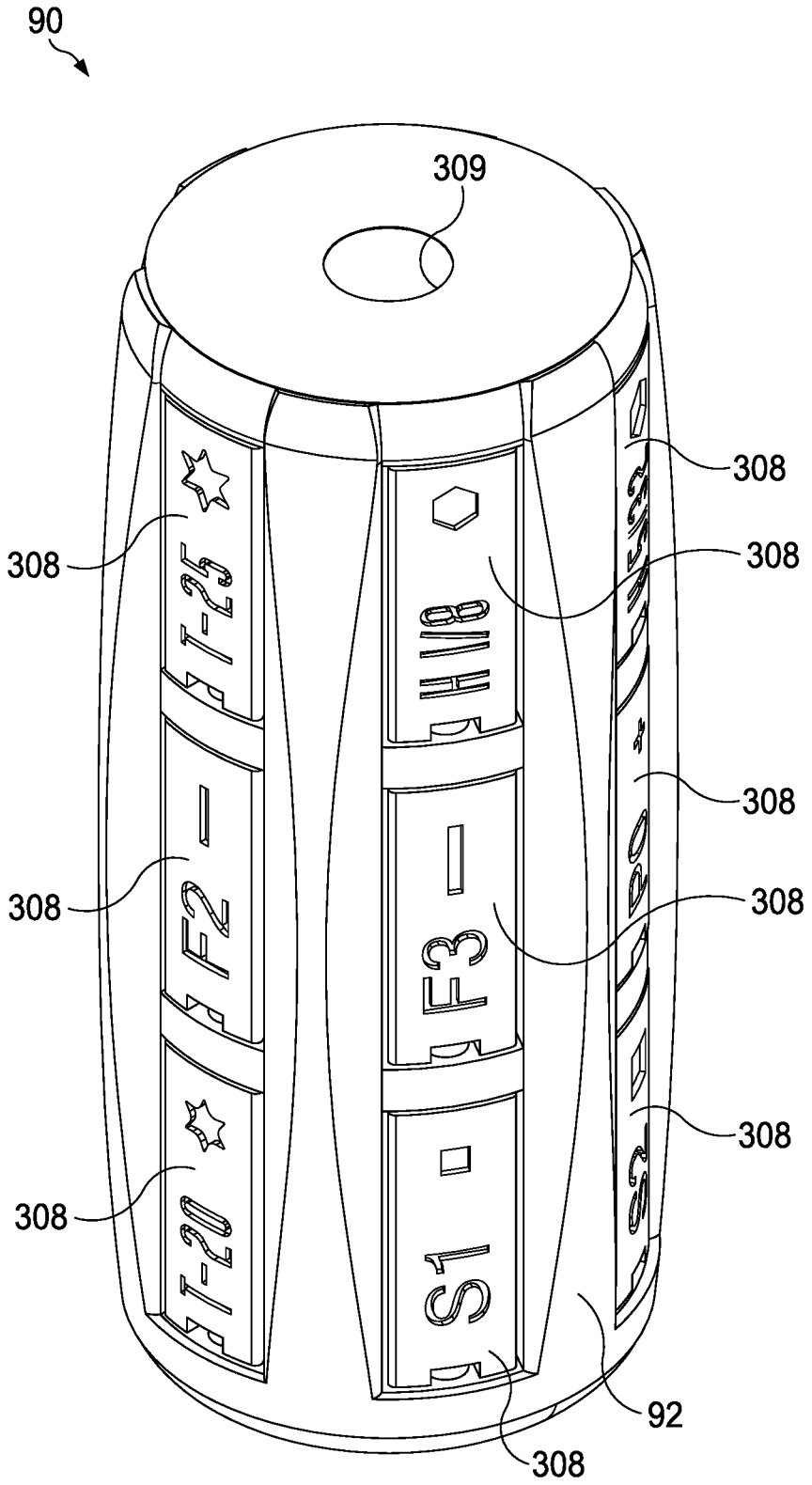
FIG. 1 is a perspective view of a storage device embodying features of the present invention.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation. Refer now to the drawings wherein like or similar elements are designated by the same reference numeral through the several views.

For purposes of definition, the term "bit" is used herein to signify any items desirable for storage, such as, by way of example, but not limitation, artist charcoal/pencils, children's crayons, drill bits, taps (for cutting threads), bobbins for sewing, spices, gauge pins, bits for a screwdriver, fishing weights, and the like. For purposes of illustration, bits will be depicted herein, by way of example, but not limitation, as a Phillips head bit in FIGS. 2A-2D, representative of any of the foregoing items desirable for storage. Terms such as "leftward," "rightward," "leftwardly," and "rightwardly," are relative terms as will be defined below with respect to respective drawings.

Referring to FIG. 1 of the drawings, the reference numeral 90 generally designates a storage device embodying features of the present invention for storing bits, as defined above. The storage device 90 includes a number of cartridges 308, each of which defines a cavity (not shown in FIG. 1) for storing a single storage item. The storage device 90 includes a receiver 92 that defines at least one cell (not shown in FIG. 1) for receiving the at least one cartridge 308, and a passageway (not shown in FIG. 1) extending longitudinally along the center of the receiver to an opening 309 defined in an external surface of the receiver for inserting items into the unit, and for retrieving items from the unit. The passageway facilitates passage of a selected storage item between a cartridge 308 cavity and the opening 309. In the interest of efficiency, the storage device 90 is described in further detail below with respect to one application relating to a multi-bit screwdriver.

Figure 1A:
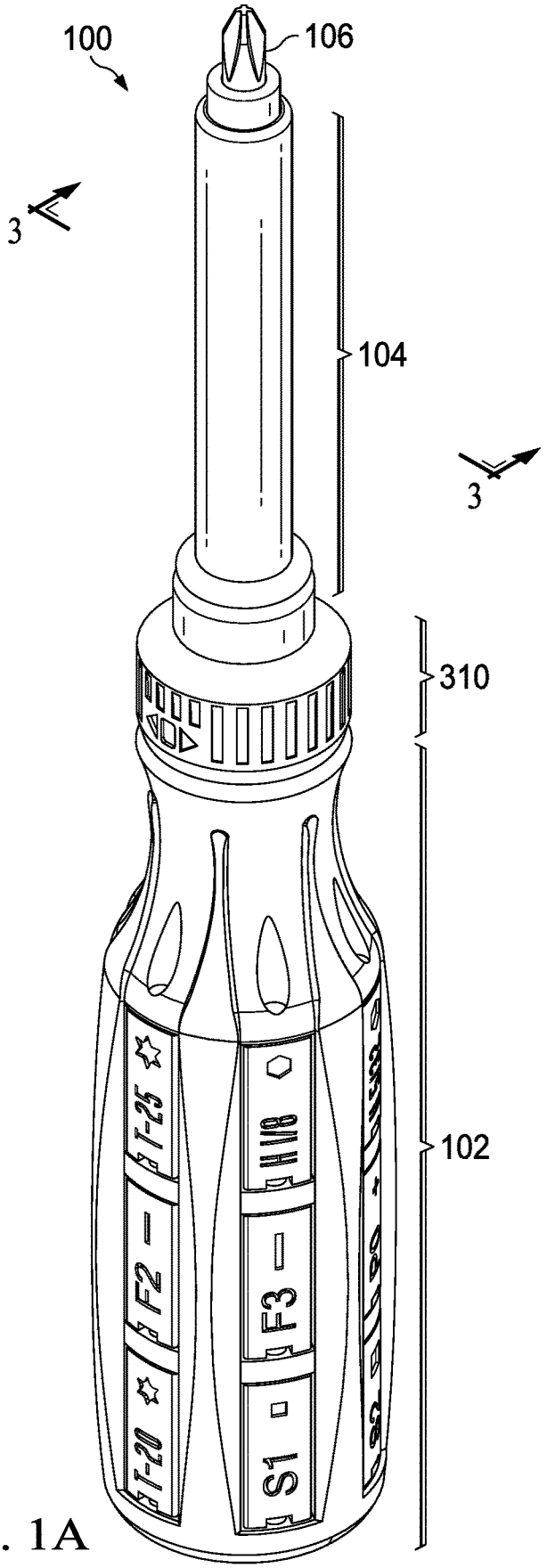
FIG. 1A is a perspective view of a screwdriver embodying features of the storage device of FIG. 1 and of the present invention.

Accordingly, in FIG. 1A of the drawings, the reference numeral 100 generally designates a multi-bit screwdriver embodying features of the present invention. Screwdriver 100 preferably includes a handle portion 102, a ratchet 310, a shaft portion 104, and a bit portion 106, all of which portions will be described in further detail below.

Figure 2A:
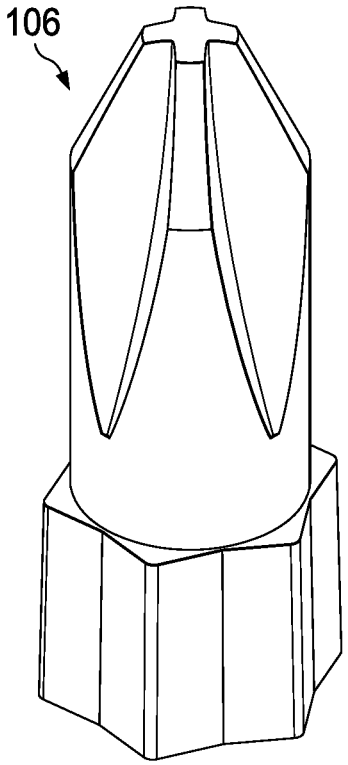
FIGS. 2A-2D exemplify a bit adapted for use with the screwdriver of FIG. 1A.
Figure 2B:
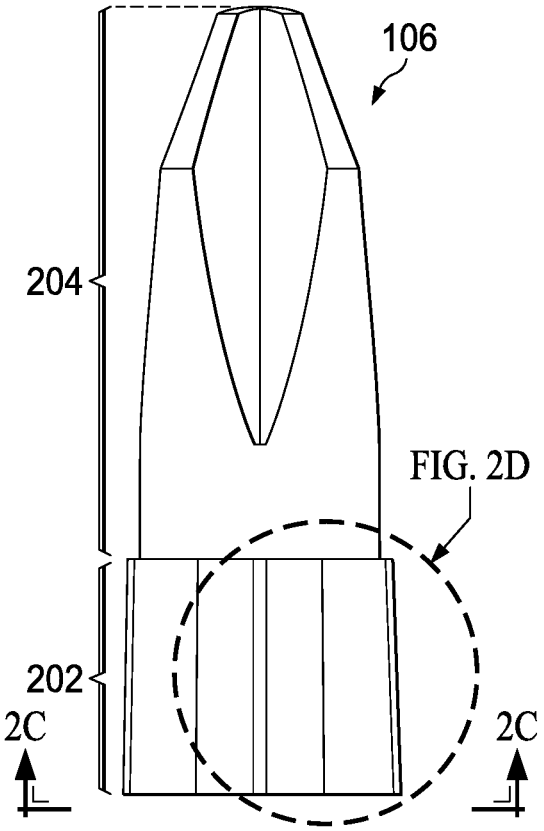
Figure 2C:
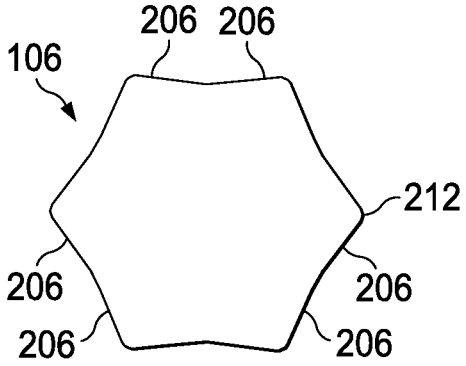
Figure 2D:
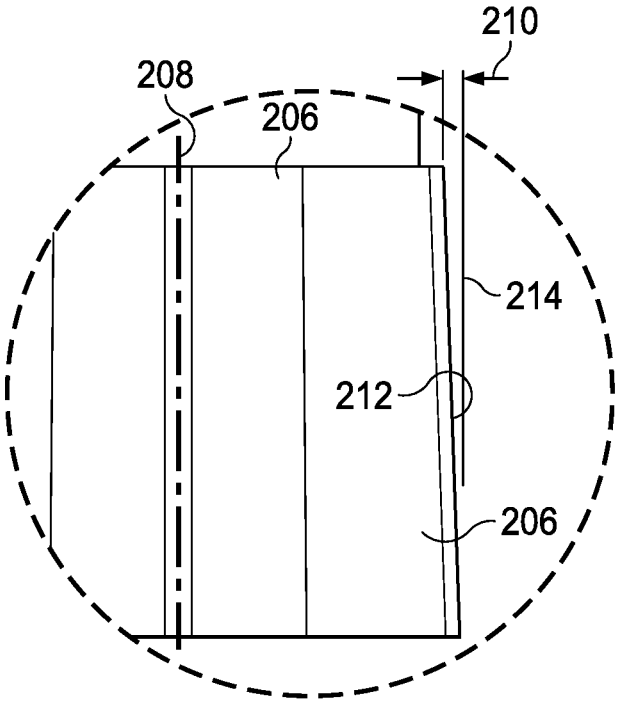

FIG. 2A is a perspective view exemplifying bit 106. FIG. 2B is a side view of bit of FIG. 2A, and as shown therein, bit 106 includes a base portion 202 and a head portion 204. Head portion 204 is depicted as a Phillips head, but may be of any suitable or desirable shape, such as a slotted (flat) head, square, hex socket, Allen, spanner head, spline drive, or the like. Base portion 202 preferably includes a number of generally concave sides or surfaces 206 arranged in any suitable shape, such as a hexagon or six-pointed star having six generally concave sides in a preferred embodiment, depicted in FIG. 2C, or in alternative embodiments, base portion 202 may define any of a number of different shapes, such as a hexagon, pentagon, octagon, or the like with sides 206 which may be flat, but which are preferably concave, or the like, having edges, such as depicted by reference numeral 212. FIG. 2D shows sides 206 of the base portion 202, and edge 212, preferably conically canted toward head portion 204 at an angle 210 from a line 214 parallel to a centerline 208 of bit 106. Angle 210 is preferably about 1°, but may vary from 0° to about 10° for reasons discussed below. Bit 106 is preferably made from substantially hard, non-magnetic material, such as high manganese steel alloy, stainless steel, or the like.

Figure 3A:
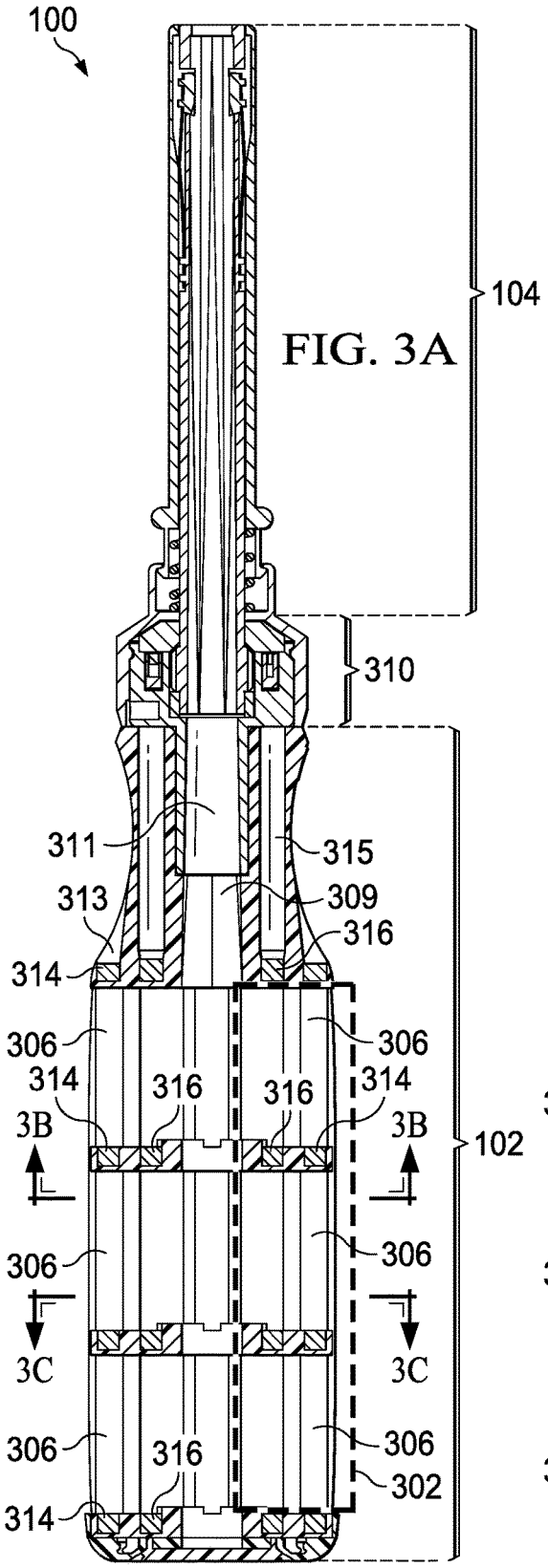
FIG. 3A is a cross-section of the screwdriver of the invention taken along line 3-3 of FIG. 1A.
Figure 3D:
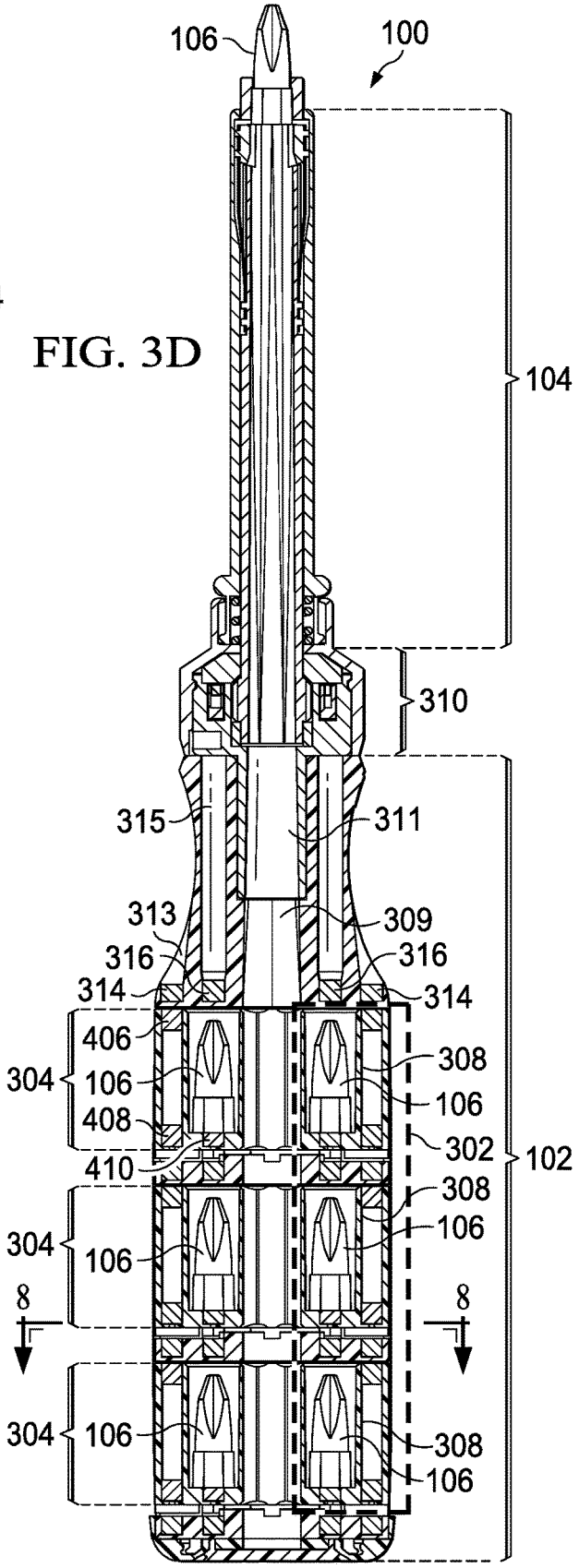
FIG. 3D is a cross-section of the screwdriver of the invention taken along line 3-3 of FIG. 1A.

FIGS. 3A and 3D are cross-sections of screwdriver 100 taken along line 3-3 of FIG. 1A. Handle 102 preferably defines six columns 302, though more or less such columns may be so defined. Each column 302 includes at least one row 304 (three of which rows are exemplified in FIG. 3D), and each row 304 of each column 302 defines one respective cell 306 for holding one respective cartridge 308, discussed below. Screwdriver 100 preferably also includes a ratchet mechanism 310, which may comprise any conventional ratchet mechanism, but preferably a ratchet as taught in co-pending patent application Ser. No. 14/677,698, filed Apr. 2, 2015, and incorporated herein by reference in its entirety.

Figure 3B:
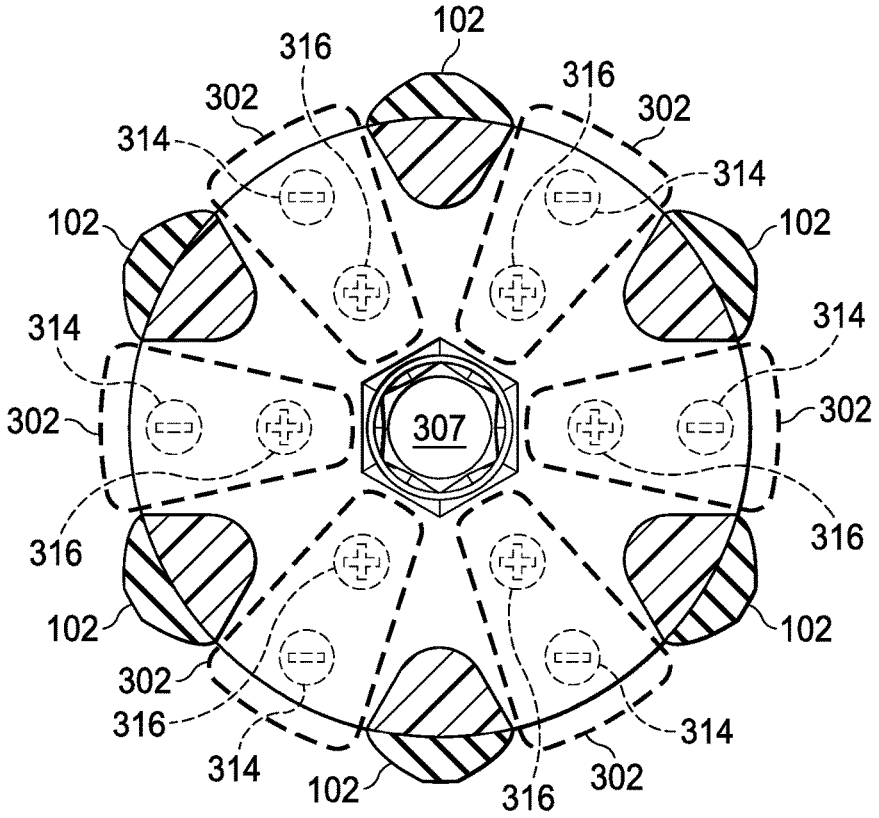
FIG. 3B is a cross-section of the screwdriver of the invention taken along line 3B-3B of FIG. 3A.
Figure 3C:
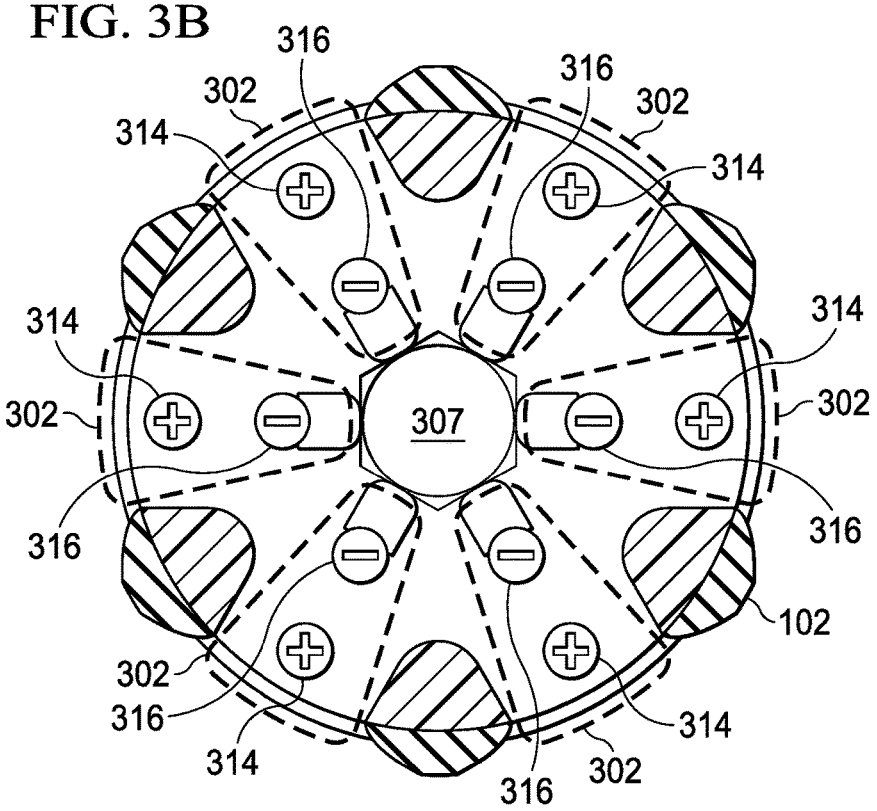
FIG. 3C is a cross-section of the screwdriver of the invention taken along line 3C-3C of FIG. 3A.
Figure 4:
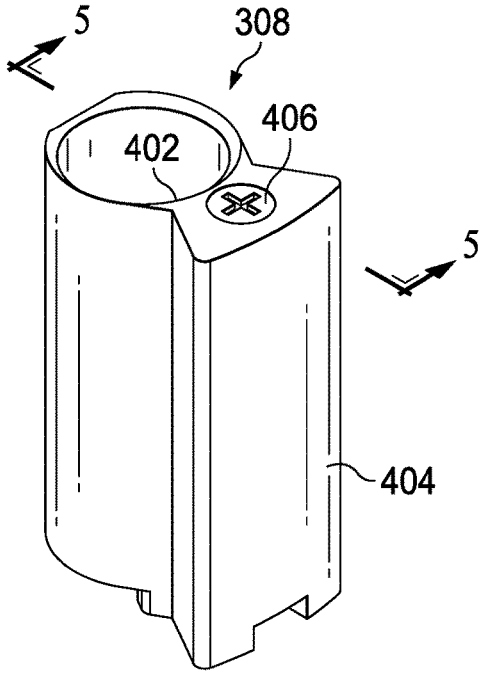
FIGS. 4-7 exemplify various views of a cartridge adapted for holding a bit for use in a screwdriver of the invention.
Figure 6A:
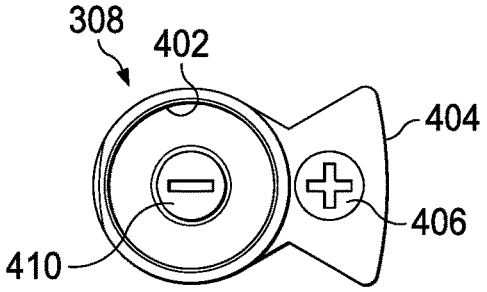
Figure 6B:
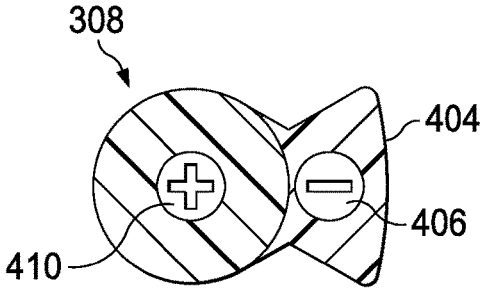
Figure 5:
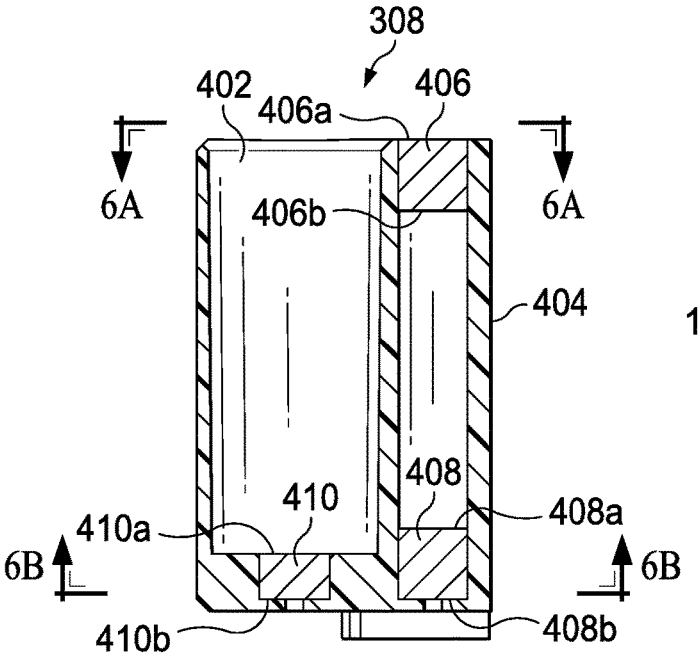
Figure 7:
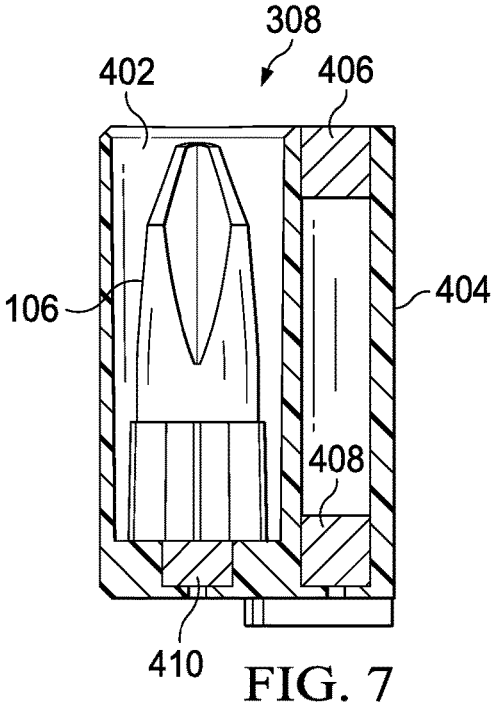

FIGS. 3B and 3C depict a view of upper and lower cell surfaces, respectively, of a row 304 of cells 306. As shown in FIG. 3C and in dashed outline in FIG. 3B, each upper and lower surface preferably includes two receiver magnets 314 and 316 embedded therein in each cell 306. The north and south polarities of the magnets are designated in the drawings by positive and negative signs ("+" and "−"), respectively. Magnets 314 and 316 are preferably oriented to have opposite polarities. While polarities of magnets 314 and 316 are depicted of particular polarities, polarities may be reversed so long as resultant magnetic interactions are consistent with interactions caused by polarities described herein.

FIGS. 4-7 depict a cartridge 308 configured to receive and hold bit 106 in cell 306, and preferably fabricated from a non-magnetic material such as plastic, high manganese steel alloy, stainless steel, or the like. Cartridge 308 defines a cavity 402 for receiving bit 106 (FIG. 7), and a button 404. Cartridge 308 preferably includes three cartridge magnets, namely, a cavity magnet 410 positioned at the bottom of cavity 402, and upper and lower magnets 406 and 408 positioned in upper and lower portions of button 404. The polarity of magnets 406 and 408 is preferably oriented the same, and opposite that of magnet 410. As exemplified most clearly in FIG. 5, the positive or north ends of magnets 406, 408, and 410 is represented by ends 406*a*, 408*a*, and 410*b* respectively; thus, as viewed in FIGS. 5, 6A, and 6B, positive or north ends 406*a* and 408*a* of magnets 406 and 408 are oriented upwardly, and the positive or north end 410*b* of magnet 410 is oriented downwardly. Conversely, the negative or south ends of magnets 406, 408, and 410 is represented by ends 406*b*, 408*b*, and 410*a* respectively; thus, as viewed in FIGS. 5, 6A, and 6B, negative or south ends 406*b* and 408*b* of magnets 406 and 408 are oriented downwardly, and the negative or south end 410*a* of magnet 410 is oriented upwardly.

Referring back to FIG. 3D, as discussed above, screwdriver 100 includes handle 102, which includes a number of columns 302, each of which columns includes at least one row 304 (three of which rows are exemplified in FIG. 3D), and each row 304 of each column 302 defines one respective cell 306. As shown in FIG. 3D, a cartridge 308 is positioned in each cell 306. For purposes of illustration, each cartridge is shown holding a Phillips head bit, though typically, various bits, discussed above, would be stored in the cartridges. Screwdriver 100 further preferably includes a passageway 309 and a funnel 311 (with a lower opening slightly larger than an upper opening) for facilitating and directing the passage of bits between passageway 307 (FIGS. 3B, 3C) of handle 102 and shaft 104. Bores 313 and 315 are preferably formed for the purpose of facilitating placement of magnets 314 and 316, respectively, in the upper row of cells 306 of handle 102.

FIG. 8A depicts a cross section of one row 304 of handle 102 taken along line 8-8 of FIG. 3D. The row is exemplified in handle 102 having six columns 302, and hence, six cells 306 and six cartridges 308. For purposes of illustration of operation, letters are appended to cartridges 308 to distinguish them, one from another. FIGS. 8B-8D will be discussed further below with respect to operation of the screwdriver.

Figure 9A:
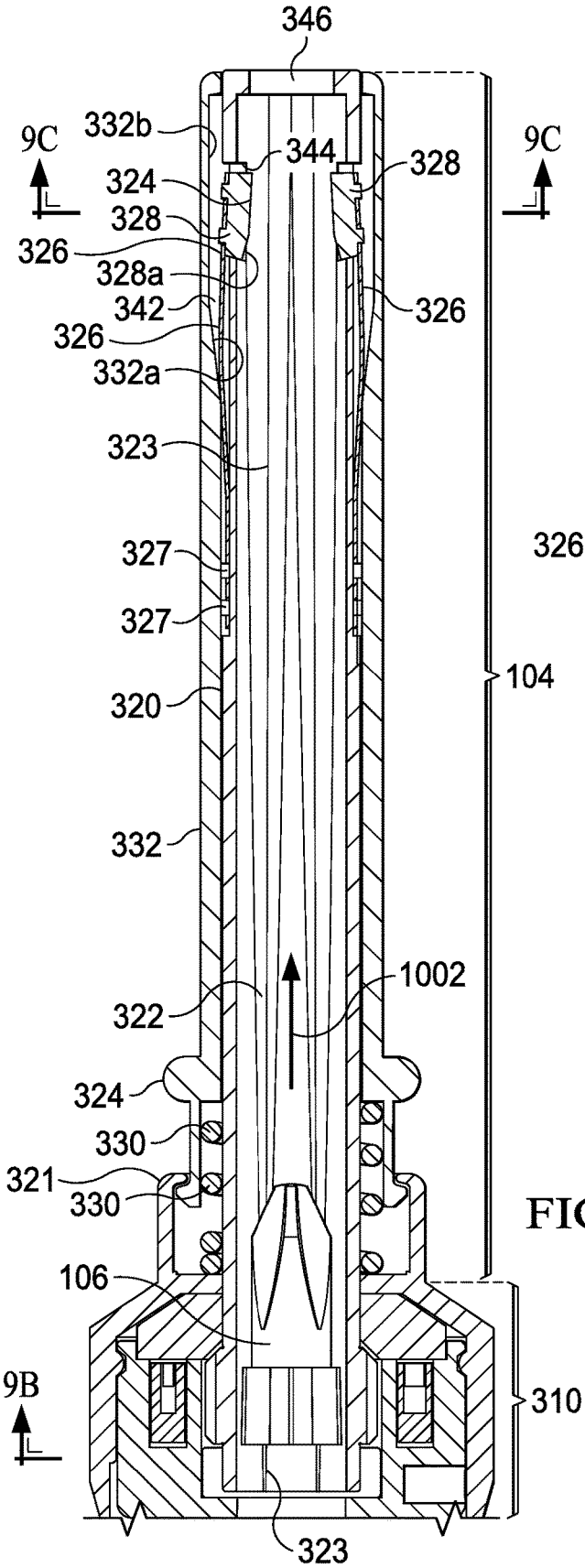
FIG. 9A exemplifies a shaft of a screwdriver of the invention.
Figure 11A:
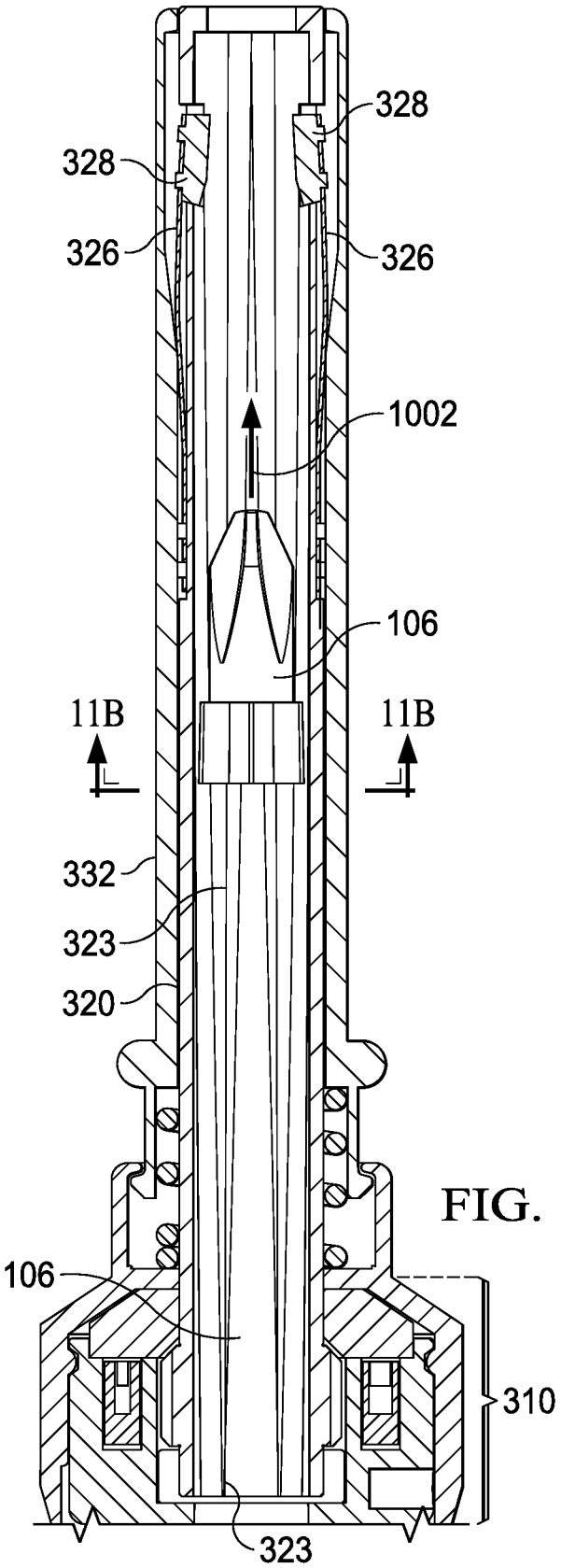
FIG. 11A exemplifies a shaft of a screwdriver of the invention having a bit moving upwardly inside a barrel of the shaft.
Figure 11B:
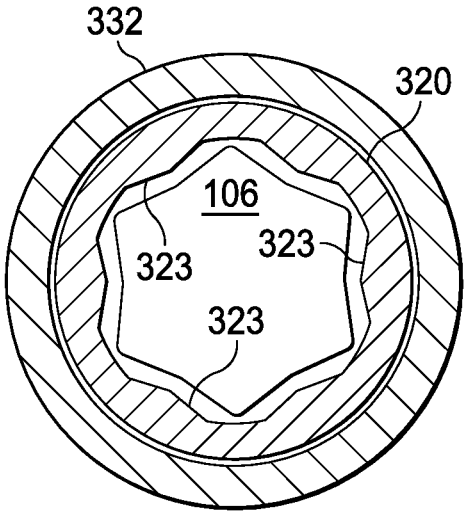
FIG. 11B shows a cross-section of the shaft taken along line 11B-11B of FIG. 11A.
Figure 12A:
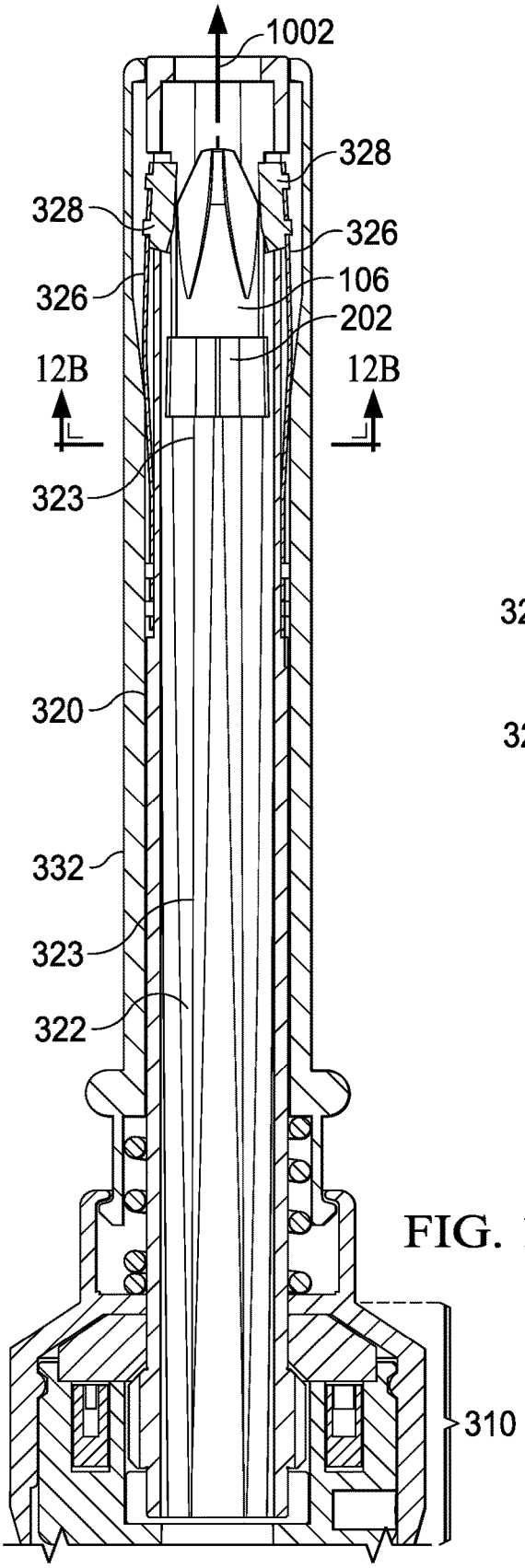
FIG. 12A exemplifies a shaft of a screwdriver of the invention having a bit moving upwardly inside a barrel of the shaft.
Figure 12B:
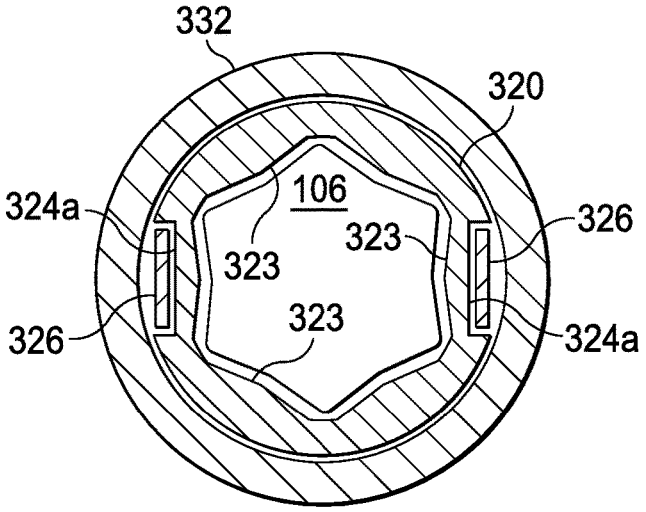
FIG. 12B shows a cross-section of the shaft taken along line 12B-12B of FIG. 12A.
Figure 13:
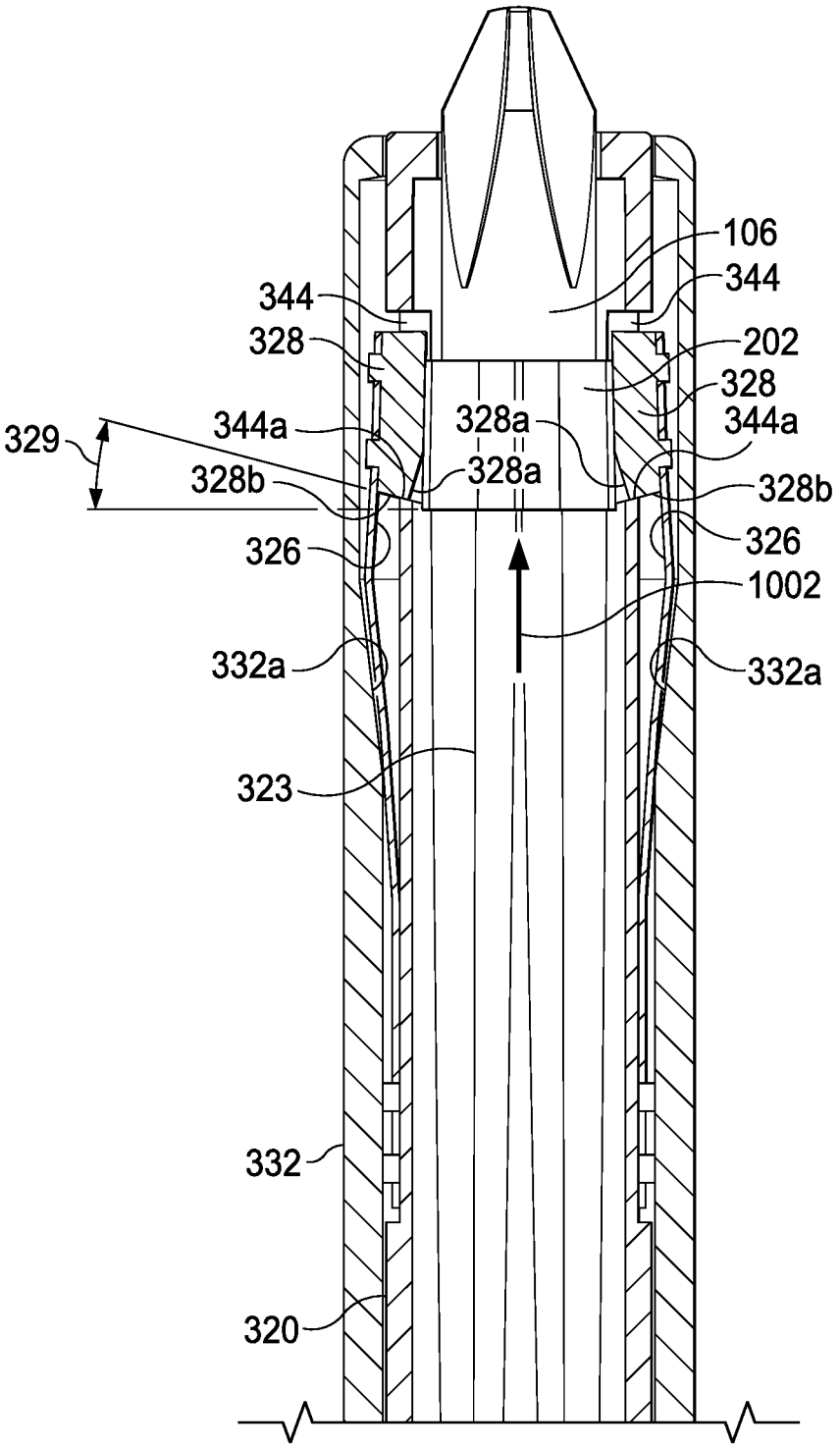
FIG. 13 exemplifies a shaft of a screwdriver of the invention having a bit moving upwardly inside a barrel of the shaft.

FIG. 9A depicts a cross-section of shaft 104 and ratchet mechanism 310 taken along line 3-3 of FIG. 1A. The shaft 104 includes a barrel 320 rotatably fixed to the ratchet mechanism 310 and handle 102. A sleeve 332 is slidably positioned about barrel 320, and restrained in axial movement by a catch 321. A spring 330 urges the sleeve against catch 321, and a finger pull 324 is positioned on the sleeve for enabling a user to use a finger (or alternatively a thumb) to pull the sleeve back against the bias of spring 330. The interior of barrel 320 is preferably configured with a number of lands 322 that are tapered so that the barrel interior has a substantially circular cross-section at a lower end (as viewed in FIG. 9A) which tapers, at an upper end (as viewed in FIG. 9A), to a substantially polygonal shape, preferably a generally hexagonal or six-pointed star shape having six generally convex sides as shown in FIGS. 12B and 14B and corresponding to the sides of the bit shown in FIG. 2C. The taper of lands 322 along the barrel are seen more clearly in FIGS. 9A-15, discussed below in connection with the operation of screwdriver 100. The number and shape of sides of the polygonal cross-section correspond to the number and shape of lands 322 of the barrel, which corresponds to the number and shape of sides of base 202 of bit 106. In a preferred embodiment, depicted in the figures, base 202 of bit 106 consists of six generally concave sides, as shown in FIG. 2C, and the barrel consists of six generally convex lands configured at the upper end to matingly engage the six generally concave sides 206 of base 202.

Figure 14A:
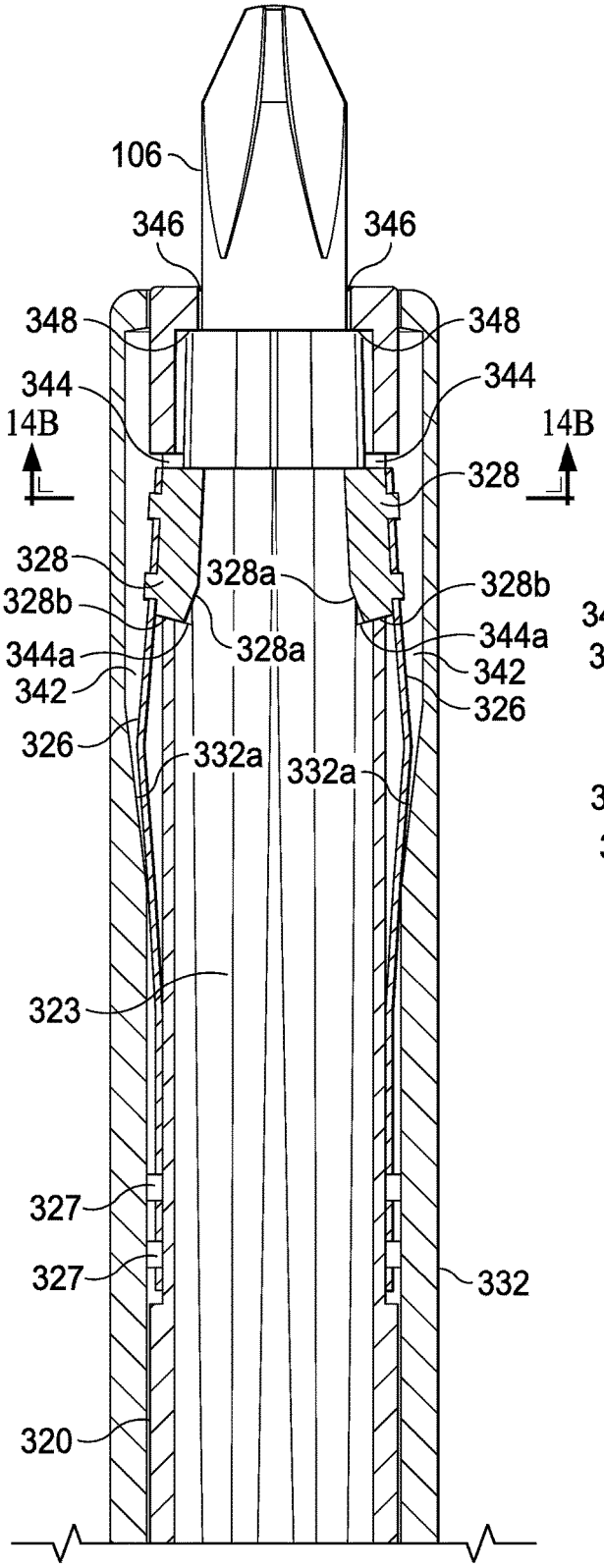
FIG. 14A exemplifies a shaft of a screwdriver of the invention having a bit in position for use.
Figure 14B:
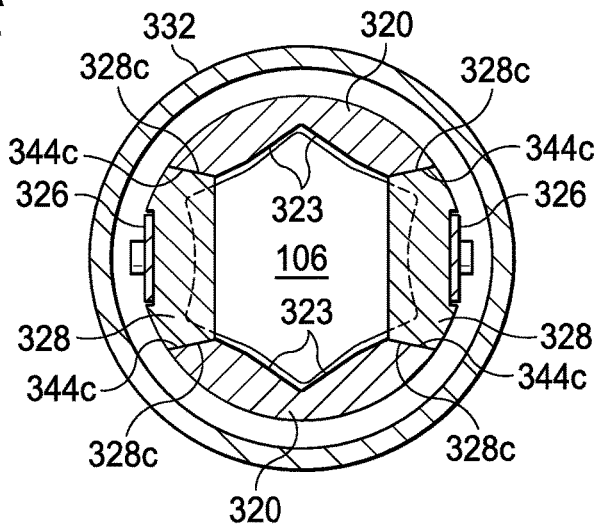
FIG. 14B shows a cross-section of the shaft taken along line 14B-14B of FIG. 14A.
Figure 15:
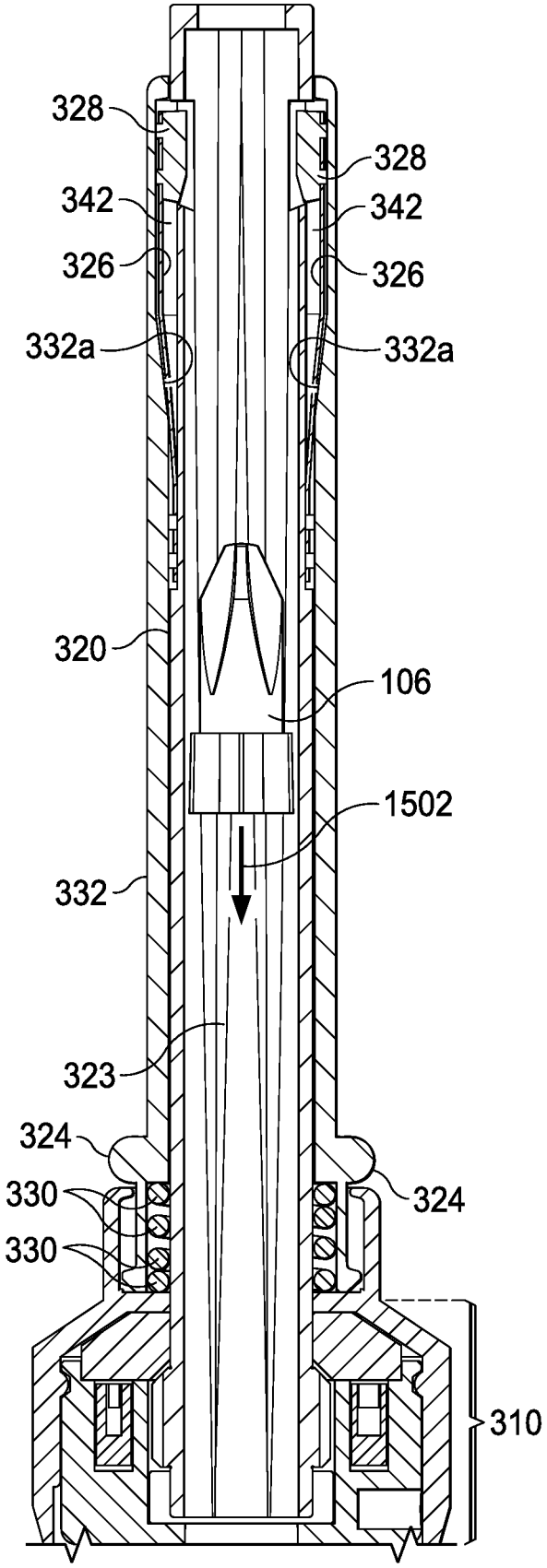
FIG. 15 exemplifies a shaft of a screwdriver of the invention having a bit moving downwardly inside a barrel of the shaft.

As more clearly depicted in FIG. 14A, toward the upper end of barrel 320 and sleeve 332, the inside diameter of sleeve 332 opens along a taper 332*a* creating space 342. A leaf spring 326 is positioned between barrel 320 and sleeve 332 and secured thereto at 327 using securing means, such as conventional staking or clipping. A locking block 328 is positioned and secured atop each leaf spring 326. When sleeve 332 is in an upward position (as shown in FIGS. 9A, 10A, 11A, 12A, 13, and 14A), the taper 332*a* presses against leaf springs 326 causing the leaf springs to bias locking blocks 328 toward two corresponding openings 344 defined in barrel 320. Locking blocks 328 are further preferably provided with bottom surfaces 328*b* which seat on corresponding lower surfaces 344*a* of openings 344, both of which bottom surfaces 328*b* and lower surfaces 344*a* are inclined downwardly into the interior of barrel 320 at an angle 329 (FIG. 13) greater than zero but less than about 30° to further bias locking blocks 328 into openings 344. To prevent locking blocks 328 from falling into and through openings 344, sides 328*c* (FIG. 14B) of the locking blocks are configured in a wedge shape which wedges against sides 344*c* of openings 344. The wedging action is particularly acute when a load is applied to bit 106 (FIG. 14A) which then urges wedge-shaped sides 328*c* of locking blocks 328 inwardly against wedge-shaped sides 344*c* of openings 344, thus providing a backstop for supporting bit 106 under load. Locking blocks 328 preferably also define tapers 328*a* at lower ends of the barrel side of the blocks, for pushing locking blocks 328 outwardly against leaf spring 326 pressure, upon contact with bit 106, and allowing bit 106 to pass when it is moving upwardly through barrel 320, as shown in FIG. 13. Leaf spring 326 pressure is such that momentum of traveling bit 106 is capable of overcoming pressure and thereby pushes locking blocks 328 out of the bit path. Once bit 106 passes the locking blocks, the locking blocks return to the position of blocking the bit from moving back into barrel 320. Bit 106 continues travel toward an opening 346 at the end of barrel 320, and is restrained from traveling out of the barrel by lock stop 348. It may be appreciated that as a user uses a finger to pull the sleeve 332 back, as depicted in FIG. 15, taper 332*a* moves downwardly allowing leaf springs 326 to expand outwardly into space 342, and locking blocks 328 to move outwardly from the openings 344 of the barrel 320. It may also be appreciated that surfaces of locking blocks 328 may be suitably curvilinear (i.e., non-flat) to conform with openings 344 and fit within the curved space 342. It may be further appreciated that the combination of locking blocks 328, leaf spring 326, sleeve 332, and lock stop 348 form a locking mechanism to secure a bit 106 in place at the end of the shaft 104.

In operation, with bits 106 loaded in cartridge cavities 402, a user selects bit 106 as shown most clearly by FIGS. 8A-8D, showing a cross-section of handle 102 taken along line 8-8 of FIG. 3D. FIG. 8A depicts an initial state of cartridges 308 in handle 102. By way of example, if a user desires to use bit 106 in cartridge 308*a*, then he would apply force with a finger to button 404 of cartridge 308*a* in a direction indicated by arrow 820. As cartridge 308*a* is pushed inwardly, cartridges 308*b* are pushed outwardly, until cartridge 308*a* is positioned as shown in FIG. 8C, at which point cartridges 308*b* are restored to their original position, which tends to hold cartridge 308*a* in its new position shown in FIG. 8C. The negative polarity of magnet 408 of cartridge 308*a* and the negative polarity of magnet 316 (FIG. 3C), together with the positive polarity of magnet 406*a* of cartridge 308*a* and magnet 316 (FIG. 3B) further tend to repel and thereby restrain cartridge 308*a* in the position of FIG. 8C.

Figure 9C:
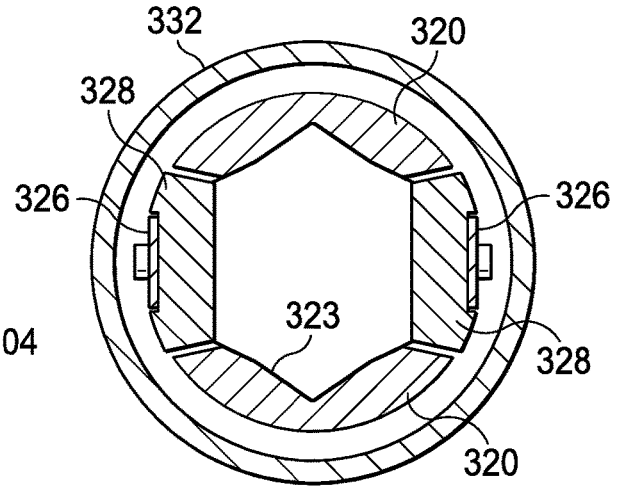
FIG. 9C shows a cross-section of the shaft taken along line 9C-9C of FIG. 9A.
Figure 9B:
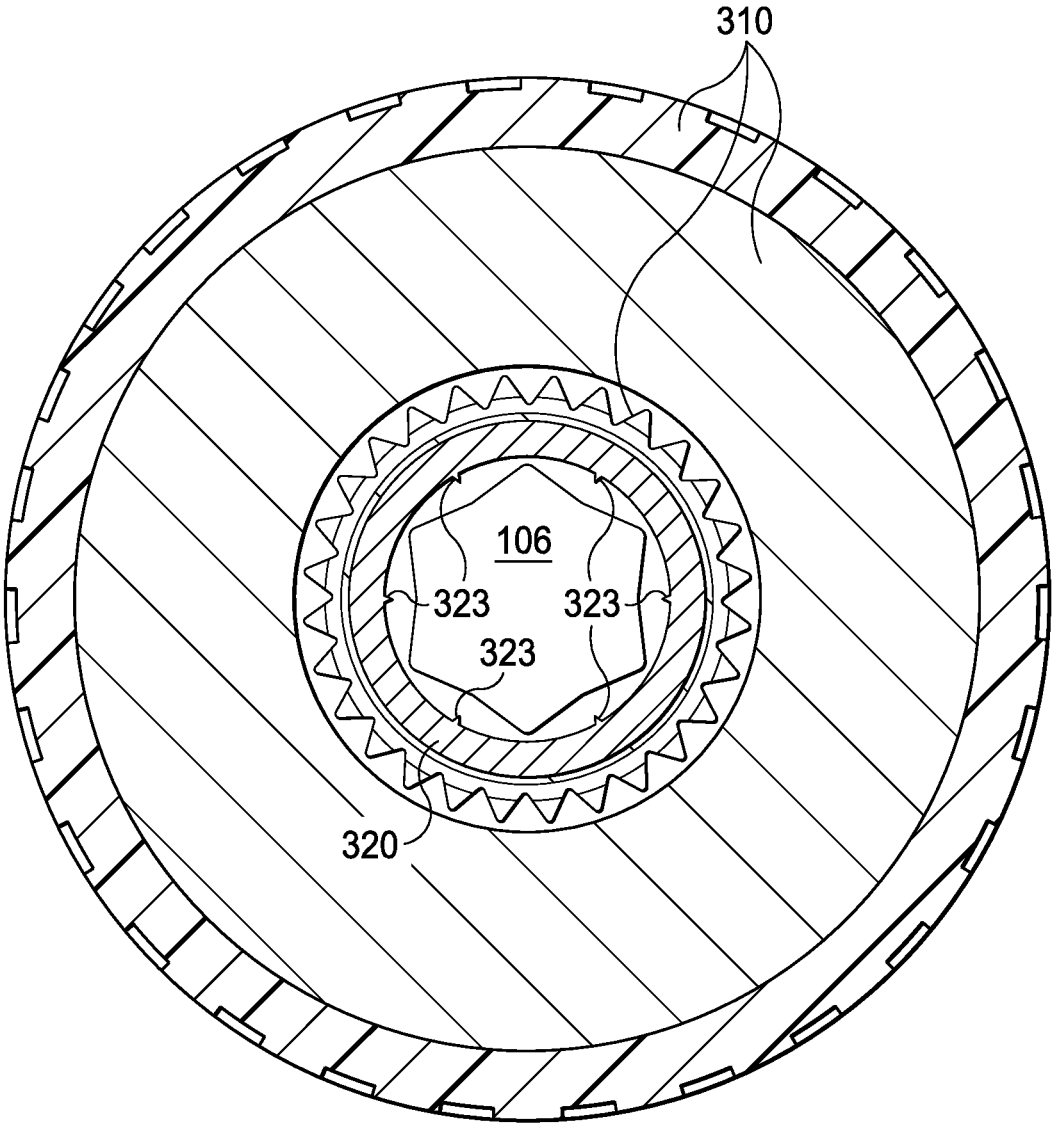
FIG. 9B shows a cross-section of the shaft taken along line 9B-9B of FIG. 9A.
Figure 10A:
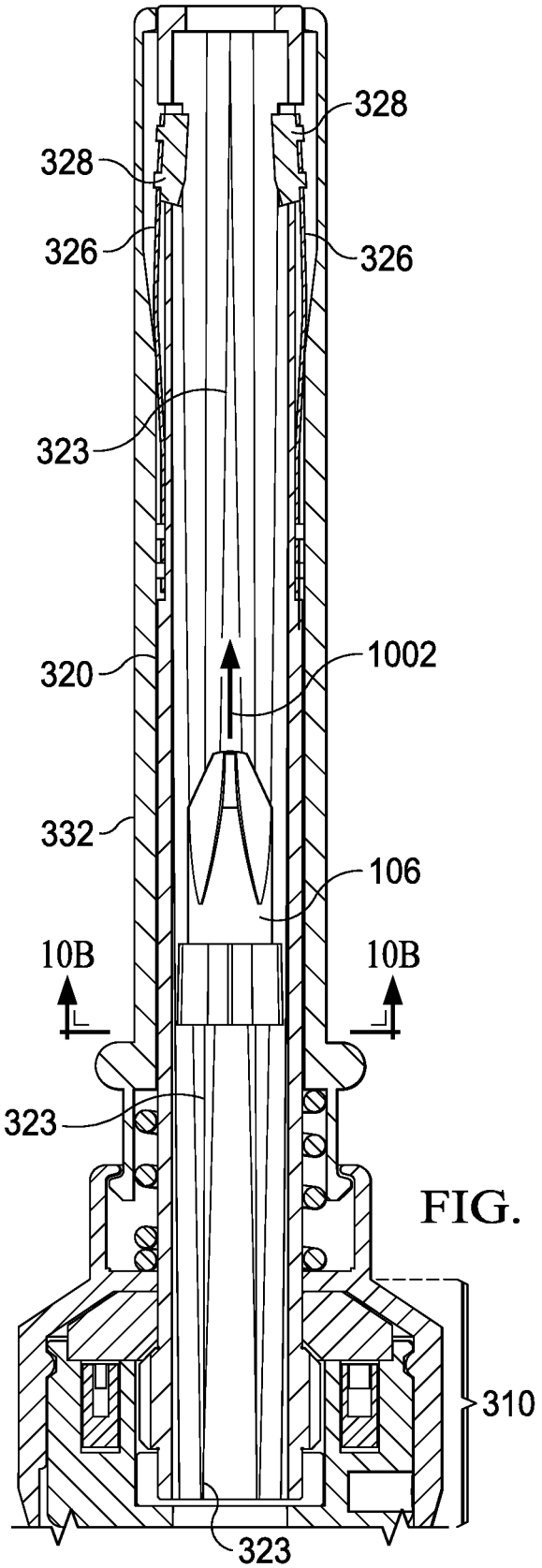
FIG. 10A exemplifies a shaft of a screwdriver of the invention having a bit moving upwardly inside a barrel of the shaft.
Figure 10B:
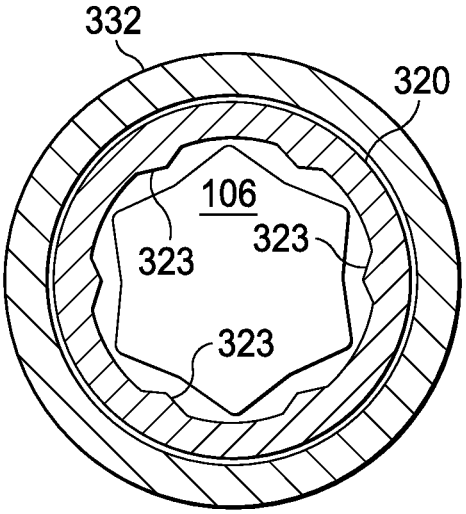
FIG. 10B shows a cross-section of the shaft taken along line 10B-10B of FIG. 10A.

Once cartridge 308*a* is in the position of FIG. 8C, the bit 106 positioned in cavity 402 of cartridge 308*a* is aligned with the center of barrel 320. A user may then flick screwdriver 100 with his or her hand to apply centrifugal force to move bit 106 into and along barrel 320 as shown in FIG. 9A. FIG. 9B shows how the barrel 320 cross-section is substantially circular, with small lands 323. FIG. 9C shows the normal position of locking blocks 328 when bit 106 is not in position for use. FIG. 10A shows bit 106 moving upwardly in the direction of arrow 1002, and FIG. 10B shows how lands 323 are enlarging. FIG. 11A shows bit 106 continuing to move upwardly in the direction of arrow 1002, and FIG. 11B shows how lands 323 continue to enlarge toward sides 206 of base 202 of bit 106. FIG. 12A shows bit 106 continuing to move upwardly in the direction of arrow 1002 toward locking blocks 328, and FIG. 12B shows how lands 323 continue to enlarge toward sides 206 of base 202 of bit 106, almost coinciding with them. FIG. 13 shows bit 106 continuing to move upwardly and engaging locking blocks 328, causing locking blocks 328 to move outwardly, against spring 326 pressure, as bit 106 passes them. FIG. 14A shows bit 106 in position just above locking blocks 328 sufficiently to allow locking blocks 328 to re-enter openings 344 and prevent bit 106 from moving downwardly, while stops 348 prevent bit 106 from moving upwardly, thereby securing bit 106 in position for use. FIG. 14B shows how lands 323 fully engage sides 206 of base 202 of bit 106, thereby preventing bit 106 from rotating, rendering bit 106 ready for use. It can be appreciated that the configuration of lands 323 allows a bit 106 to enter barrel 320 at virtually any angular orientation, and to be adjusted in its orientation as it moves along inside the barrel so that at the upper end of the barrel, the bit is properly oriented with shaft 104, secured therein, and ready for use in screwdriver 100.

With reference to FIG. 15, when bit 106 is no longer needed or another bit is desired, bit 106 may be restored to its cartridge 308 by using a finger or thumb to pull downwardly on finger pulls 324, thereby pulling taper 332*a* back, and allowing leaf springs 326 to expand outwardly into space 342, thereby allowing bit 106 to fall back into the barrel, as indicated by arrow 1502, until it lands in cavity 402 of its respective cartridge 308, positioned as shown in FIG. 8C. With reference to FIG. 8D, a user may then press button 404 of cartridge 308*d* in the direction of arrow 822 to push cartridge 308*a* in the direction of arrow 824 back to its original position of FIG. 8A, but without pushing cartridge 308*d* to a position as shown by cartridge 308*a* in FIG. 8C. When cartridge 308*d* pushes cartridge 308*a* far enough for magnets 406 and 408 (FIGS. 4-7) of cartridge 308*a* to pass over magnets 316 (FIGS. 3B, 3C), the magnetic force repels the cartridge back to its original position as shown in FIG. 8A. At this point, the user stops pushing in the direction of arrow 822 and magnetic forces of magnets 316 (FIGS. 3B, 3C) attracting cartridge 308*d* magnets 406, 408 and 410, attract cartridge 308*d* back to its original position, shown in FIG. 8A.

If bits 106 have not been or are not loaded into cartridge cavities 402, then, with reference to FIGS. 8B and 8C, a user may continue pushing cartridge 308*a* until cartridge 308*a* engages and pushes cartridge 308*d* far enough out of its respective cell 306 so that a user may grab and pull cartridge 308*a* out of respective cell 306. A bit 106 may then be loaded into cavity 402 of cartridge 308*d*. Cartridge 308*d* is then placed back into its respective receiver cell 306 and pushed in until it engages cartridge 308*a* as shown in FIG. 8D and pushes cartridge 308*a* until its respective magnets 314 and 316 pull cartridge 308*a* back to a proper position in its respective cell 306. Cartridge 308*d* is then released so that its respective magnets 314 and 316 may pull cartridge 308*d* back to its proper position within its respective cell 306. The same procedure used to load bits 106 may also be used to unload or remove bits 106 from a cartridge cavity 402, or to replace bits 106 with other bits 106.

Figure 16:
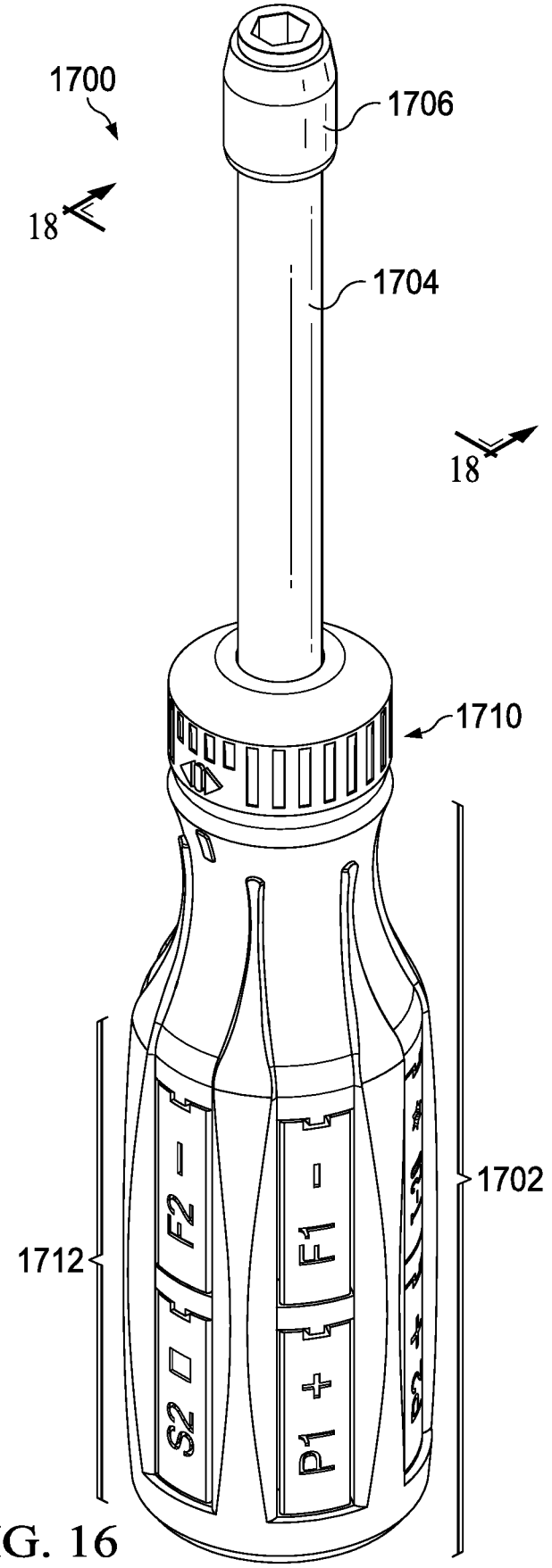
FIG. 16 is a perspective view exemplifying a screwdriver of an alternate embodiment of the invention.
Figure 17:
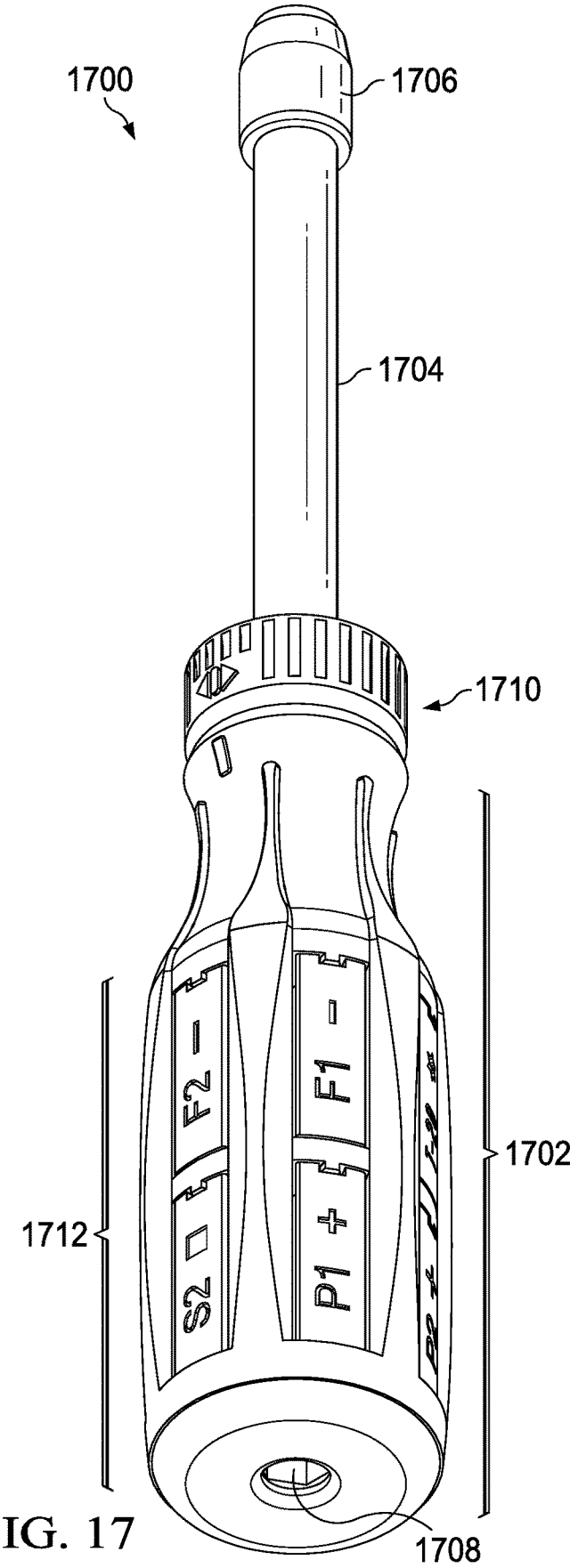
FIG. 17 is a perspective view of the screwdriver of FIG. 16, showing a lower end of the screwdriver.

FIG. 16 depicts a screwdriver 1700 according to an alternate embodiment of the invention, similar to the embodiment of screwdriver 100 described above with respect to FIGS. 1A-15, but in which a selected bit 106 is dropped out of an opening defined in a lower end of the handle, rather than being passed through the shaft 1704. Accordingly, as shown in FIG. 16, screwdriver 1700 preferably includes a handle 1702, a ratchet 1710, a shaft 1704, and a driver 1706. The handle 1702 includes a bit holder portion 1712. As shown in FIG. 17, a lower end of handle 1702 defines an opening 1708 through which bits 106 may fall out, as discussed below.

Figure 18:
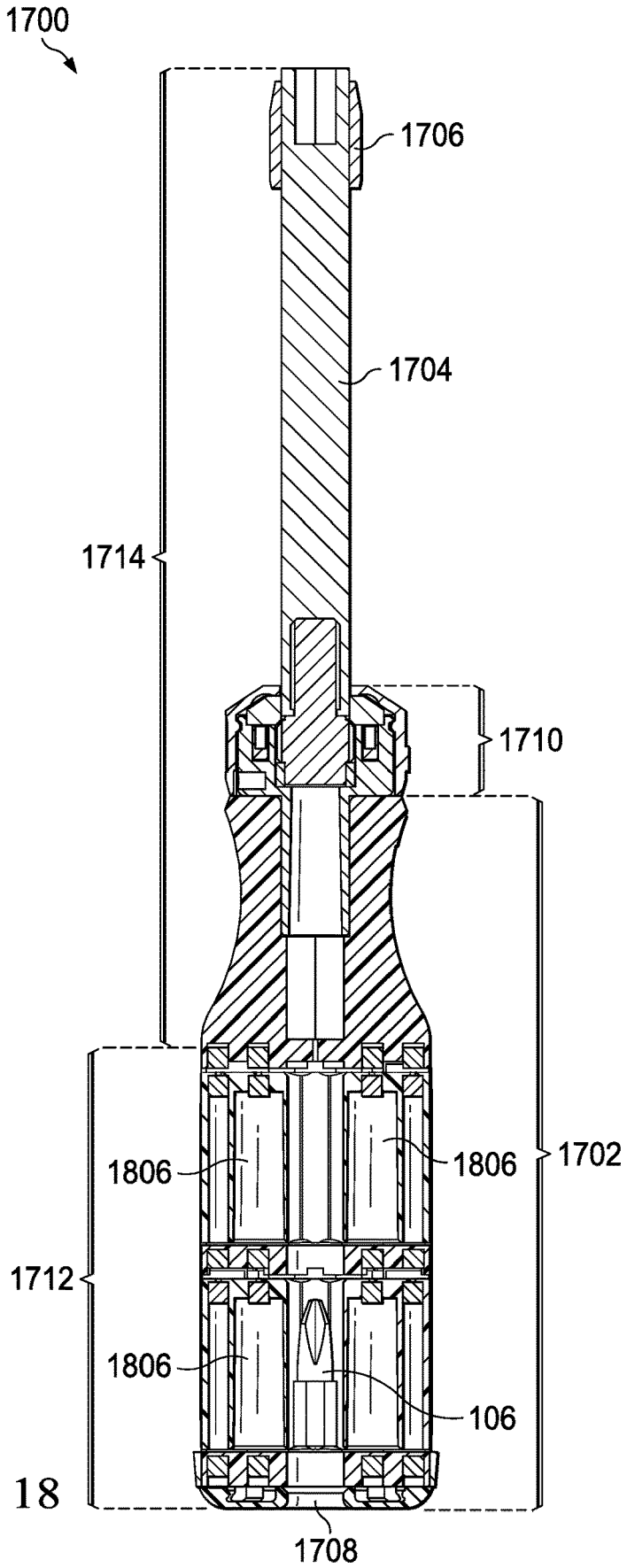
FIG. 18 is a cross-sectional view of the screwdriver of FIG. 16 taken along line 18-18 of FIG. 16.

FIG. 18 depicts a cross-section of screwdriver 1700 taken along the line 18-18 of FIG. 16. Bit holder portion 1712 of handle 1702 as shown is configured with six columns and two rows defining twelve cells 1806 for holding up to twelve cartridges and bits 106 in a manner similar to screwdriver 100 described above. As with the embodiment described above with respect to FIGS. 1A-15, the number of columns may vary from six columns, and the number of rows may vary from two or three. While not shown, cells 1806 are adapted for receiving the same cartridges 308 as described above with respect to screwdriver 100 of FIGS. 1A-15. Cells 1806 are virtually identical to cells 306 but for being oriented 180° (about a horizontal axis) from cells 306 relative to the rest of the screwdriver, and therefore will not be described in further detail herein.

A portion 1714 of screwdriver 1700 above bit holder 1712 is configurable in any suitable manner as a conventional screwdriver, and therefore will not be discussed in further detail herein.

Operation of screwdriver 1700 of FIGS. 16-18 is similar to operation of screwdriver 100 of FIGS. 1A-15, except when a user presses button 404 of cartridge 308, a bit falls downwardly, as viewed in FIG. 18, and out through opening 1708, for capture by a user. The user then mounts bit 106 onto driver 1706. When work using the bit 106 is complete, the bit is manually removed from driver 1706, the screwdriver is oriented with opening 1708 facing upwardly, and the bit is placed in opening 1708, wherein it falls into cartridge 308 from whence it came, and the cartridge is pushed back into position shown in FIG. 8A and discussed above.

FIGS. 19-28 depict a power screwdriver 2100 according to an alternate embodiment of the invention wherein multi-bit screwdriver 100 is adapted for being driven by a power tool, such as a power drill (FIGS. 27-28), by adding a shank to a bottom end of the screwdriver, and an outer cover 2112 configured to prevent cartridges 308 from flying out of respective cells from centrifugal force generated when a power drill spins the screwdriver at high speeds. Since power screwdriver 2100 contains many components that are similar or identical to those of screwdriver 100, exemplified by FIGS. 2-15, such components are referred to by the same reference numerals and will not be described in any further detail.

Figure 19:
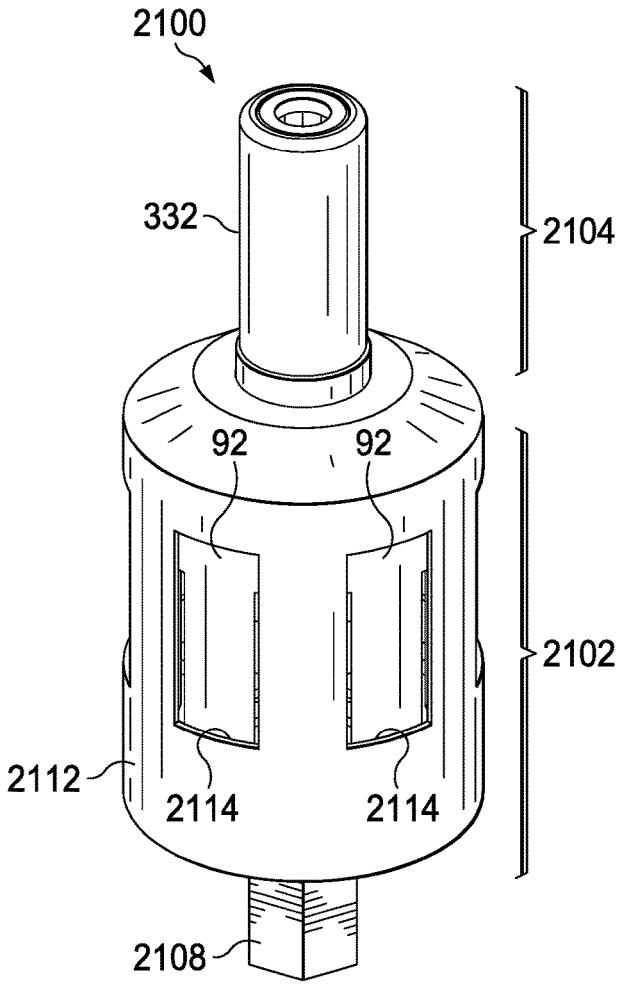
FIGS. 19 and 20 are perspective views of a further alternate embodiment of the invention embodying principles of the present invention.
Figure 20:
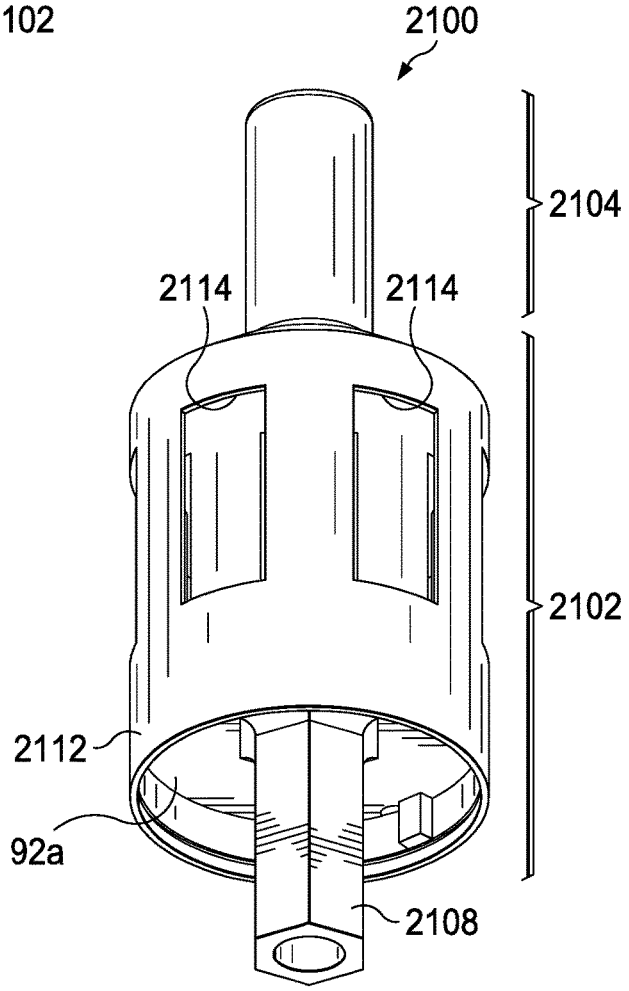

FIGS. 19 and 20 show two perspective views of one embodiment of power screwdriver 2100, including a shank 2108 extending from a bottom side 92*a* of receiver 92, and wherein receiver 92 comprises only a single row 304 (FIG. 3D) of cells 306 (FIG. 3A) and a shaft 2104 is similar to shaft 104, but is relatively shorter. It is understood that power screwdriver 2100 may be configured with multiple rows 304 of cells 306 and that shaft 2104 may be scaled longer or shorter. In a preferred embodiment, an outer cover 2112 envelopes cells 306 of receiver 92, and defines openings 2114 configured for providing access to cells 306 of the receiver. Outer cover 2112 is preferably coupled to or integral with sleeve 332 to move synchronously with the sleeve.

Figure 21:
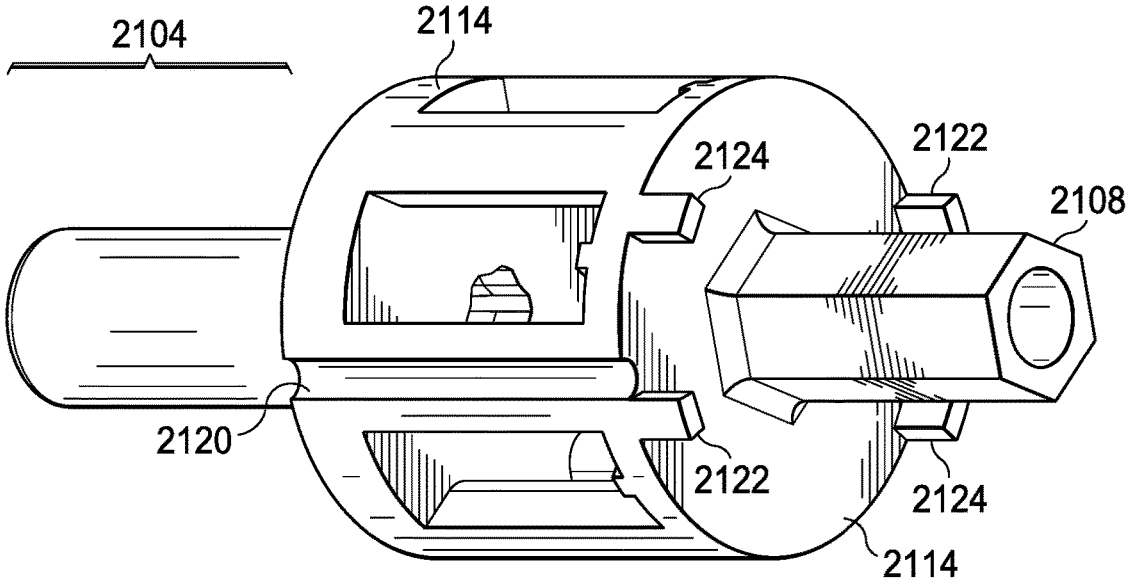
FIG. 21 exemplifies a receiver of the screwdriver without an outer cover.

FIG. 21 shows power screwdriver 2100 receiver 92 without outer cover 2112. As depicted, a longitudinal groove 2120 is defined in the receiver. In a preferred embodiment, a second longitudinal groove (not shown) is defined on an opposing side of the receiver.

Figure 22:
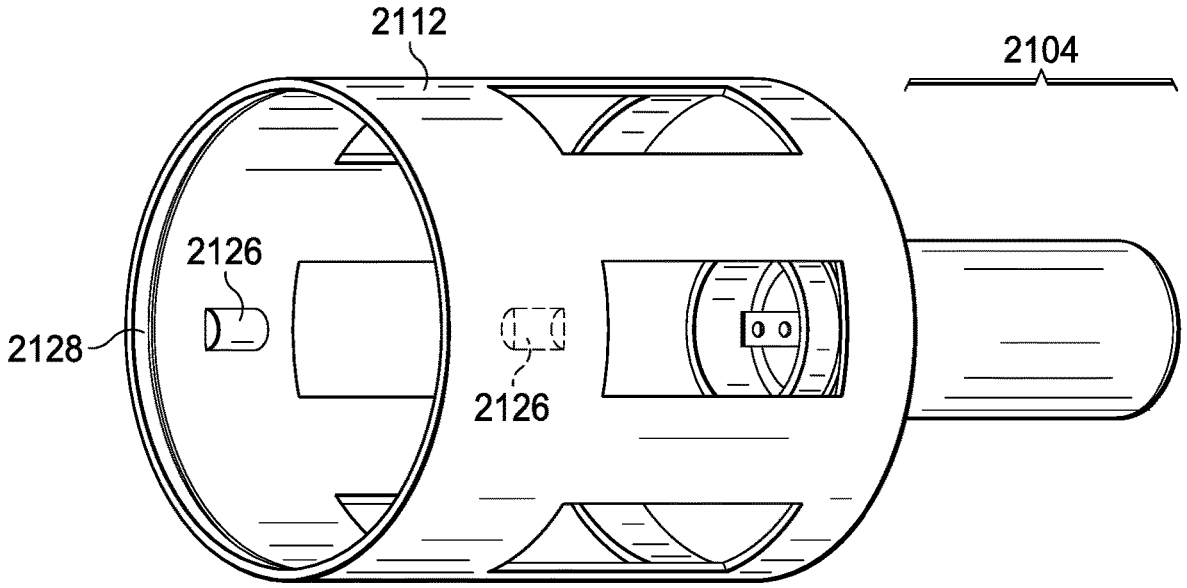
FIG. 22 exemplifies an outer cover of the screwdriver without a receiver.

FIG. 22 shows the power screwdriver 2100 outer cover 2112 without receiver 92. As depicted, two tongues 2126 extend inwardly from an inward surface of the outer cover. Tongues 2126 are configured to matingly engage and slide along complementary grooves 2120 when outer cover 2112 is positioned about receiver 92. It is noted that outer cover 2112 is coupled to sleeve 332 for synchronous movement with the sleeve. Thus, coil spring 330 (see, e.g., FIG. 9A) that biases sleeve 332 in a forward (upward, as viewed in FIG. 23) position toward the end of shaft 2104, also biases outer cover 2112 in a forward position. A retaining ring (not shown) or the like is preferably positioned in a groove 2128 in an end of outer cover 2112 to limit the bias of spring 330 and the forward movement of outer cover 2112.

Figure 24:
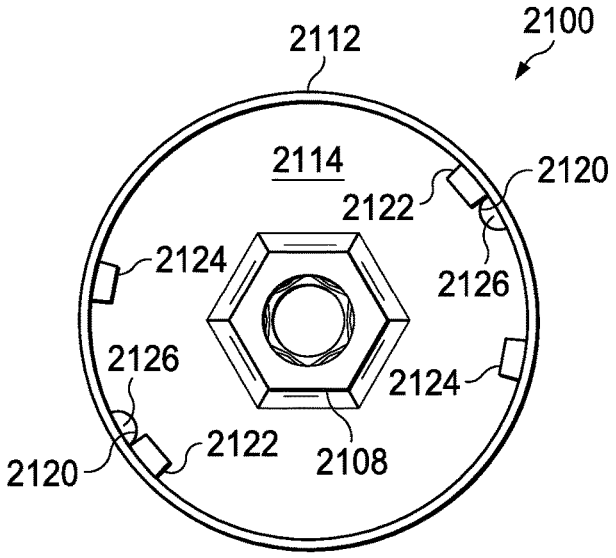
FIG. 24 is a bottom view of the screwdriver of FIG. 23 taken along the line 24-24 of FIG. 23.
Figure 23:
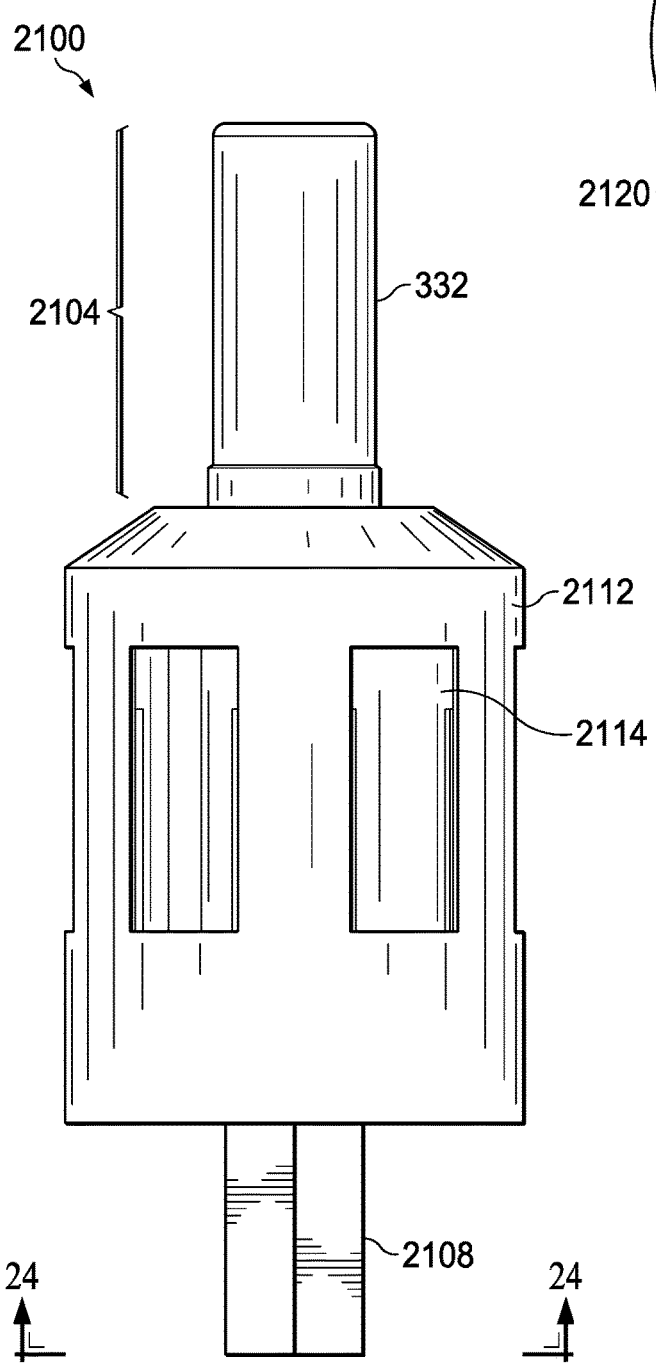
FIG. 23 exemplifies a side view of the screwdriver in a locked position for operation.

FIGS. 23 and 24 illustrate an operating mode of power screwdriver 2100. As shown most clearly in FIG. 24, two tongues 2126 engage complementary grooves 2120 permitting spring 330 to slide outer cover 2112 and sleeve 332 into a forward position. In such position, outer cover 2112 covers cells 306, precluding external access to cartridges 308, and also preventing cartridges 308 from flying out of respective cells from centrifugal force generated when a power drill spins screwdriver 2100 at high speeds. It is noted that open stops 2122 and closed stops 2124 limit how much outer cover 2112 can be rotated when opening or closing, respectively, outer cover 2112.

Figure 26:
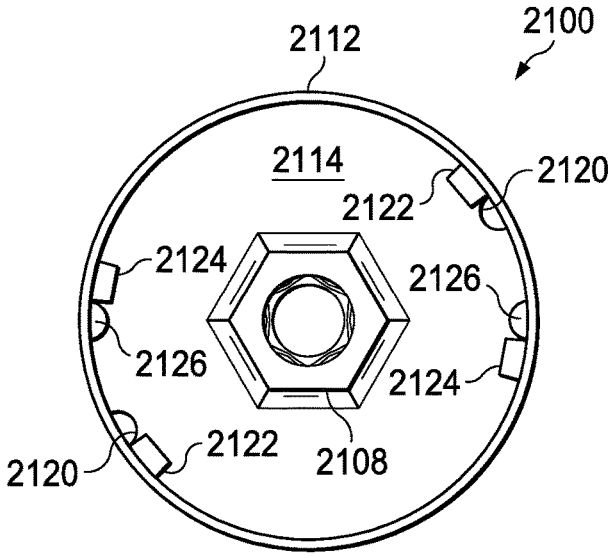
FIG. 26 is a bottom view of the screwdriver of FIG. 25 taken along the line 26-26 of FIG. 25.
Figure 25:
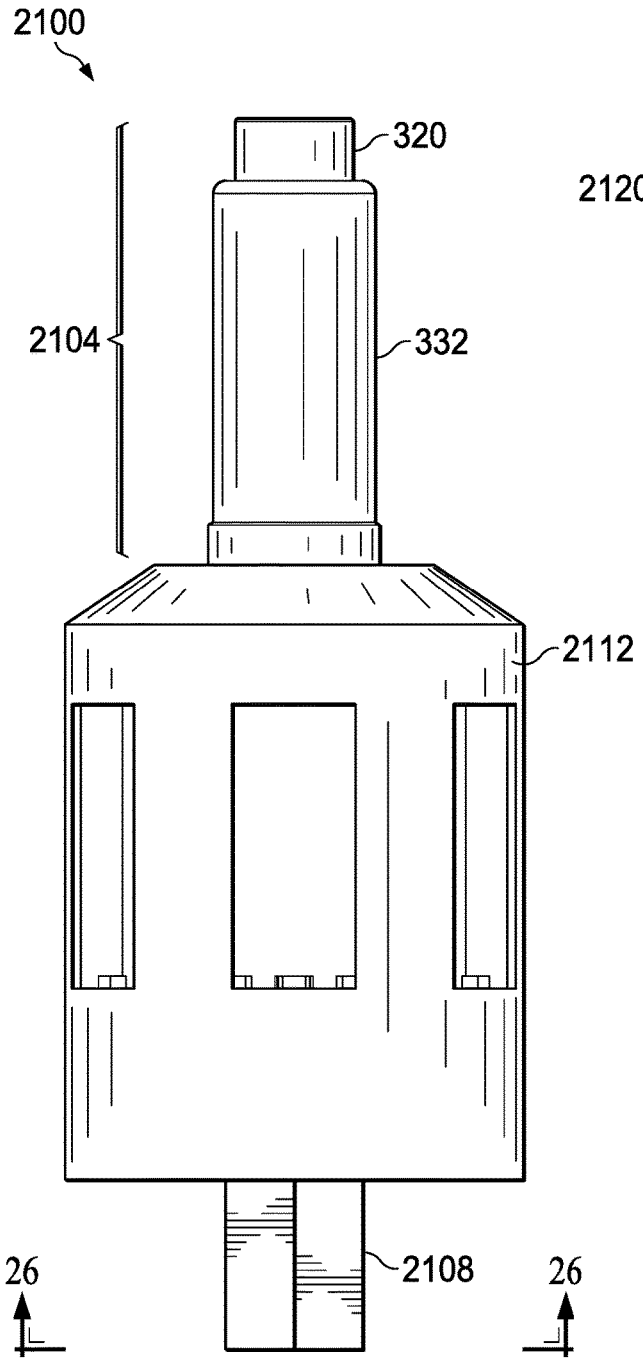
FIG. 25 exemplifies a side view of the screwdriver in an unlocked position for changing a bit.

FIGS. 25 and 26 illustrate a bit changing mode of power screwdriver 2100. As shown most clearly in FIG. 26, two tongues 2126 do not engage complementary grooves 2120, and so restrain outer cover 2112 and sleeve 332 in a rearward position. In such position, outer cover 2112 allows access to cells 306, thereby permitting external access to cartridges 308 so bits 106 may be selected, removed, or changed, as discussed above with respect to FIGS. 2-15.

Figure 27:
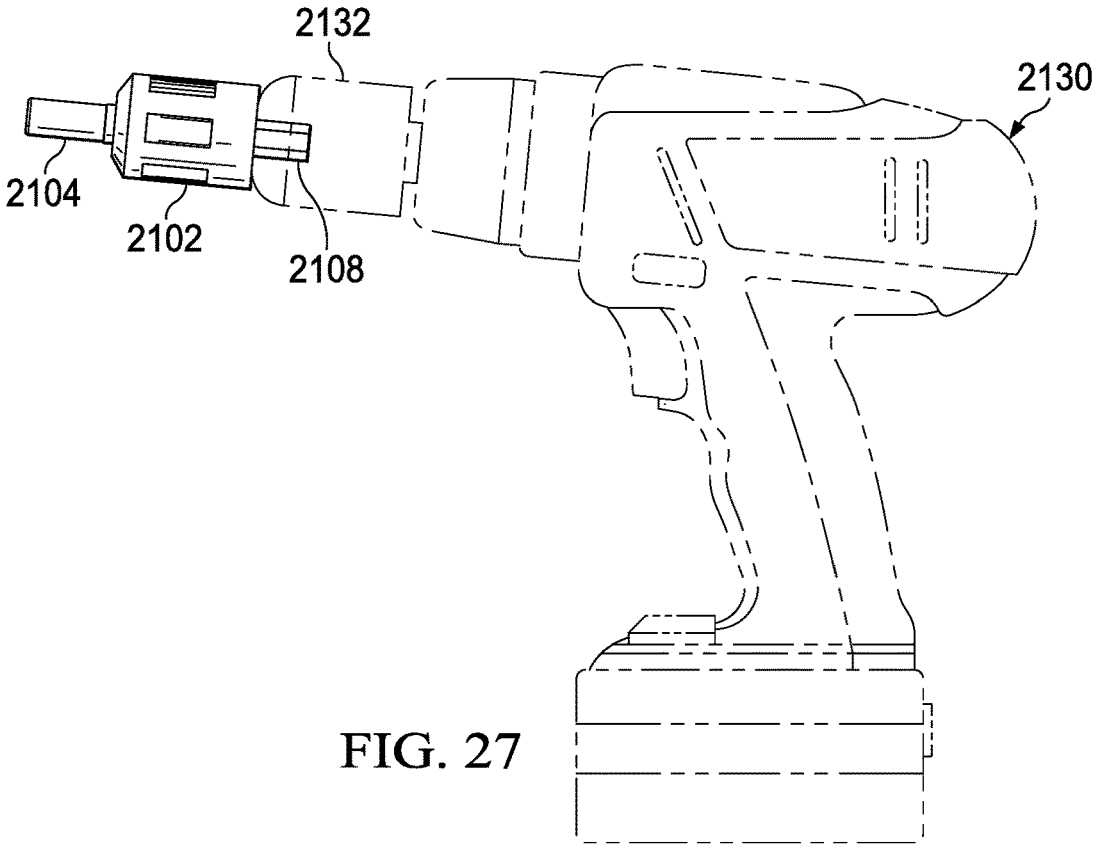
FIG. 27 exemplifies how the embodiment of FIGS. 19 and 20 may be mounted to a chuck of a power drill.
Figure 28:
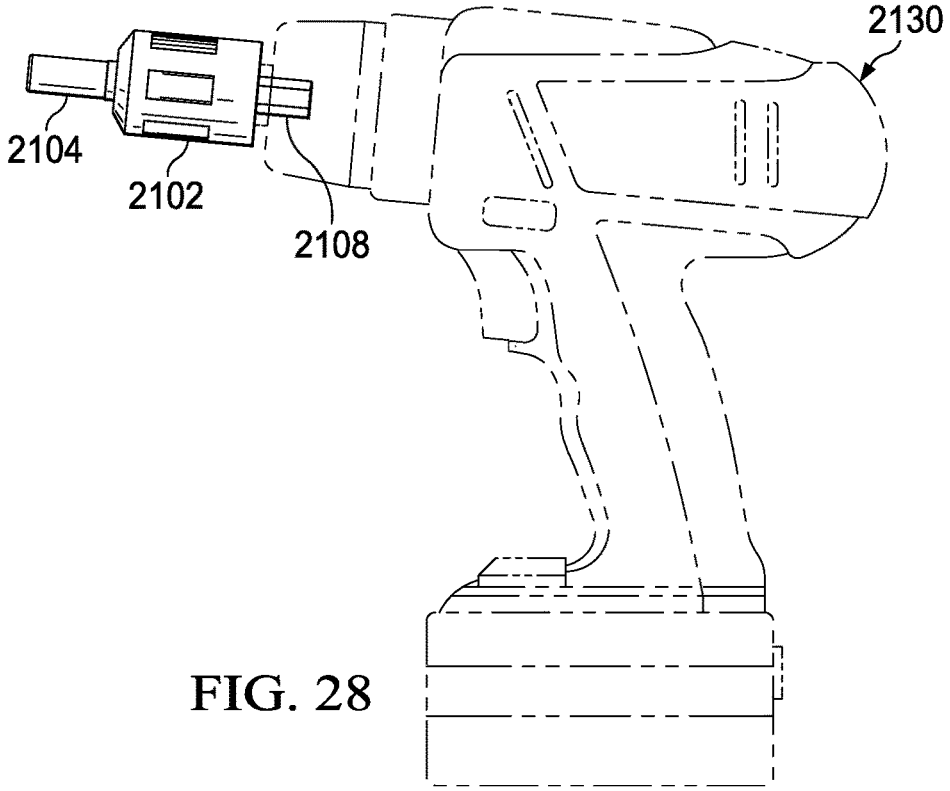
FIG. 28 exemplifies how the embodiment of FIGS. 19 and 20 may be permanently mounted to a power drill.

FIGS. 27 and 28 exemplify how screwdriver 2100 may be coupled to a power drill 2130. In FIG. 27, shank 2108 is secured in a chuck 2132 to thereby form a temporary coupling. In FIG. 28, a more permanent coupling between screwdriver 2100 and power drill 2130 is formed when shank 2108 is secured directly to power drill 2130.

FIGS. 29-40 depict details of a storage device 3090, also exemplified as a multi-bit screwdriver 3000, according to a further alternate embodiment of the present invention, wherein the function previously achieved using magnets is now achieved using springs. Since storage devices 3000 and 3090 contain many components that are identical to those of previous embodiments, these components are referred to by the same reference numerals and will not be described in any further detail.

Figure 29:
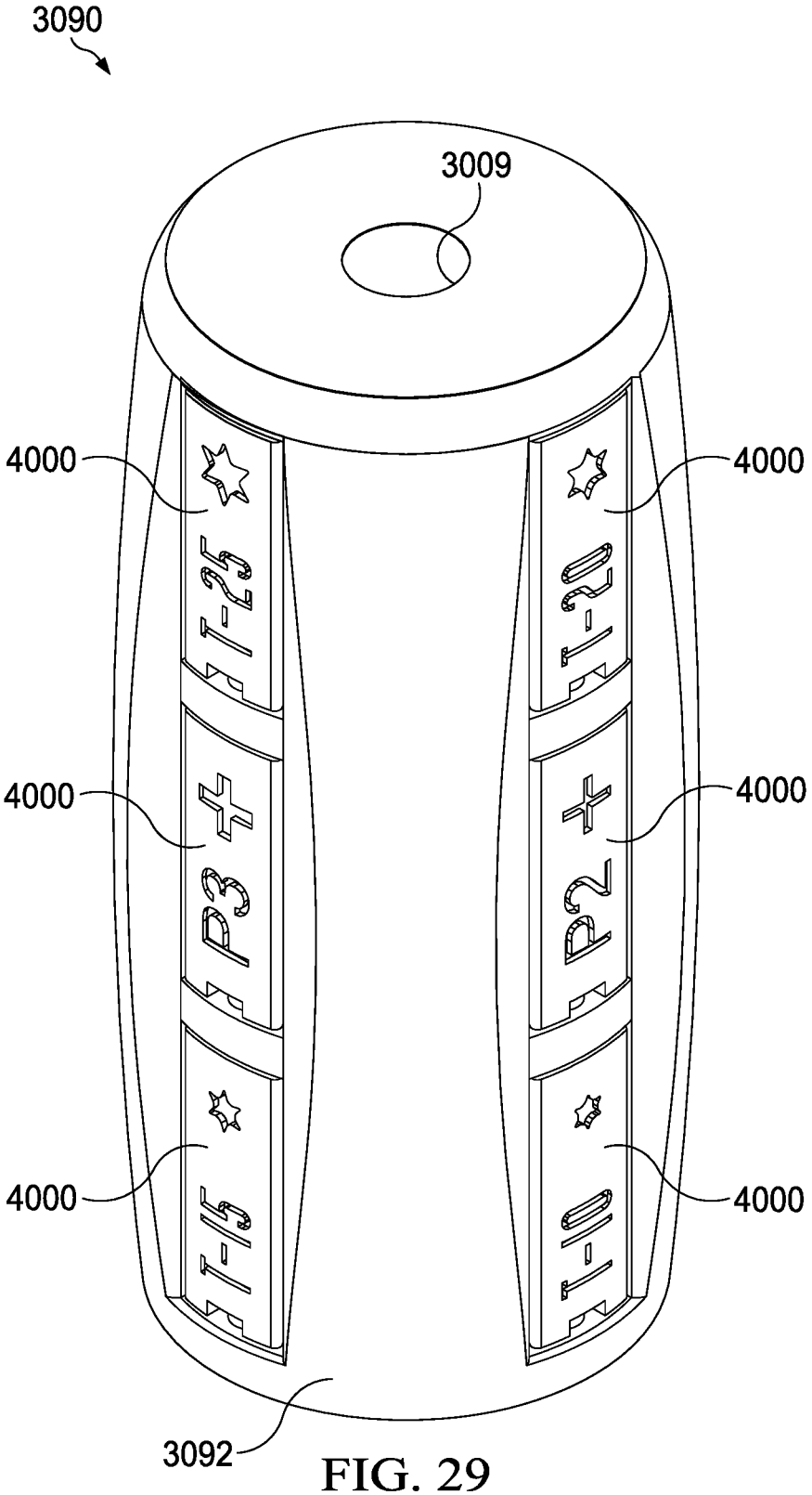
FIG. 29 is a perspective view of a still further alternate embodiment of the storage device embodying features of the present invention.

More specifically, according to the embodiment of FIG. 29, the reference numeral 3090 generally designates an alternative embodiment of a storage device, similar to the embodiment of FIG. 1, embodying features of the present invention for storing bits, as defined above. Storage device 3090 includes a receiver 3092 that defines at least one cell (not shown in FIG. 29) for receiving at least one cartridge 4000 defining a cavity for storing a storage item. Storage device 3090 further includes a passageway extending longitudinally along the center of the receiver to an opening 3009 defined in an external surface of the receiver for inserting items into the unit, and for retrieving items from the unit. Passageway 3009 facilitates passage of a selected bit between a cartridge 4000 cavity and the opening 3009. In the interest of efficiency, the storage functionality of device 3090 is described in further detail below with respect to one application relating to a multi-bit screwdriver.

Figure 30:
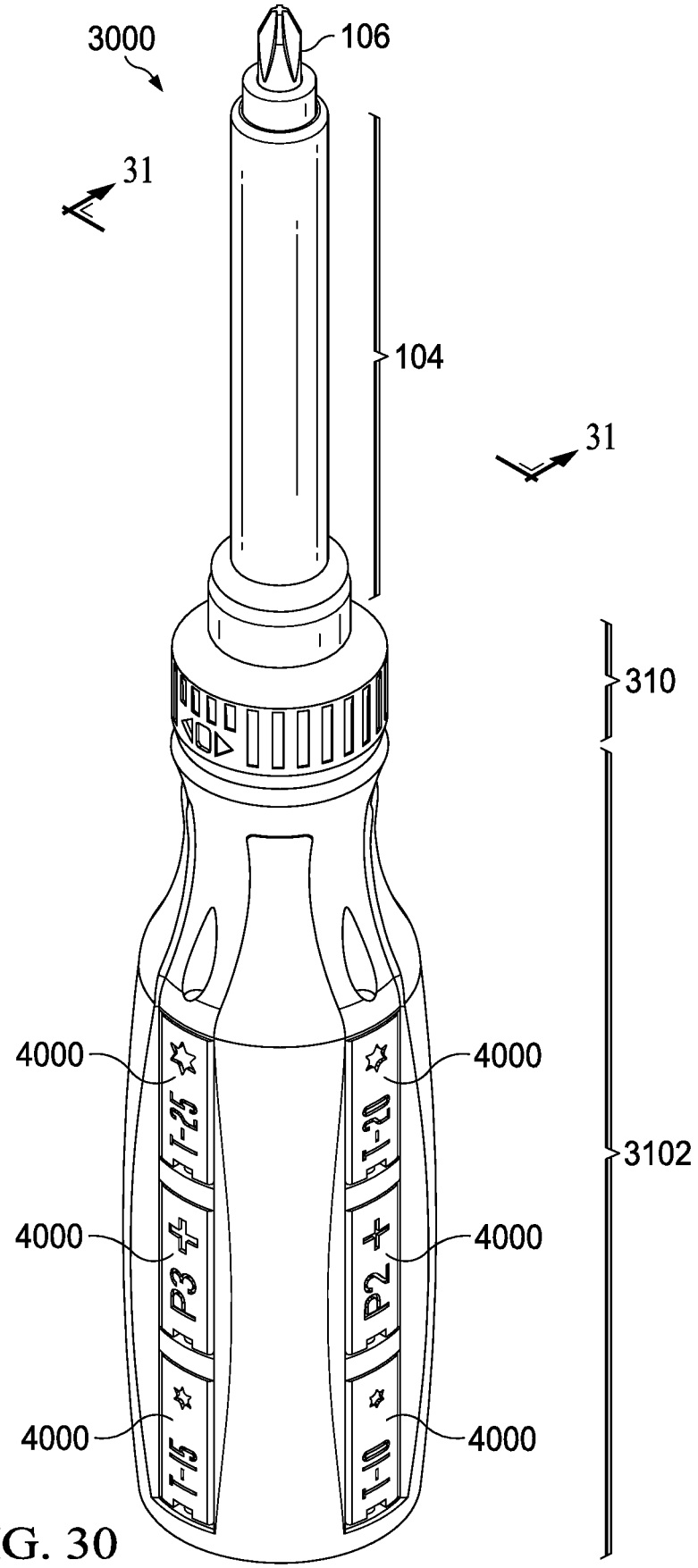
FIG. 30 is a perspective view of an alternate embodiment of a screwdriver embodying features of the storage device of FIG. 29 and further of the present invention.

Accordingly, in FIG. 30 of the drawings, the reference numeral 3000 generally designates a multi-bit screwdriver embodying features of the present invention. Screwdriver 3000 preferably includes a handle portion 3102, a ratchet 310, a shaft portion 104, and a bit portion 106. Ratchet 310, shaft portion 104, and bit portion 106 have been described in some detail above, and so will not be described in further detail herein, but handle portion 3102 will be described in further detail below.

Figure 31:
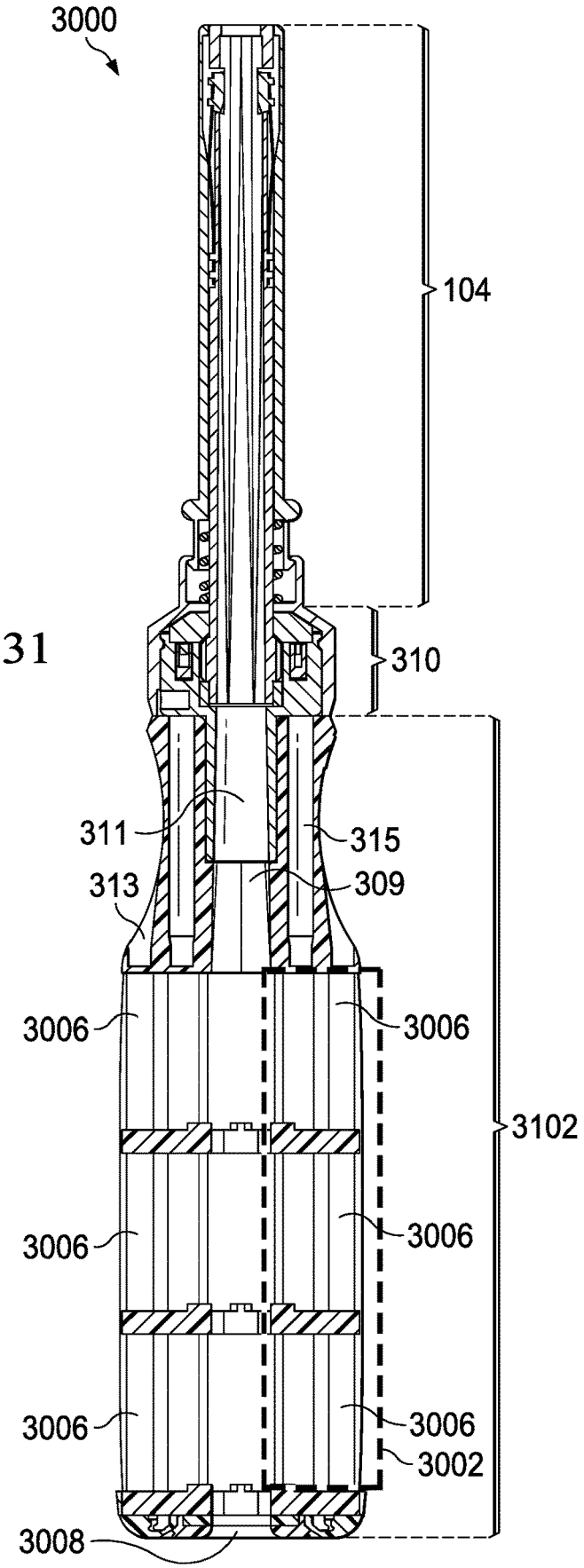
FIG. 31 is a cross-section of the screwdriver of the invention taken along line 31-31 of FIG. 30.
Figure 32:
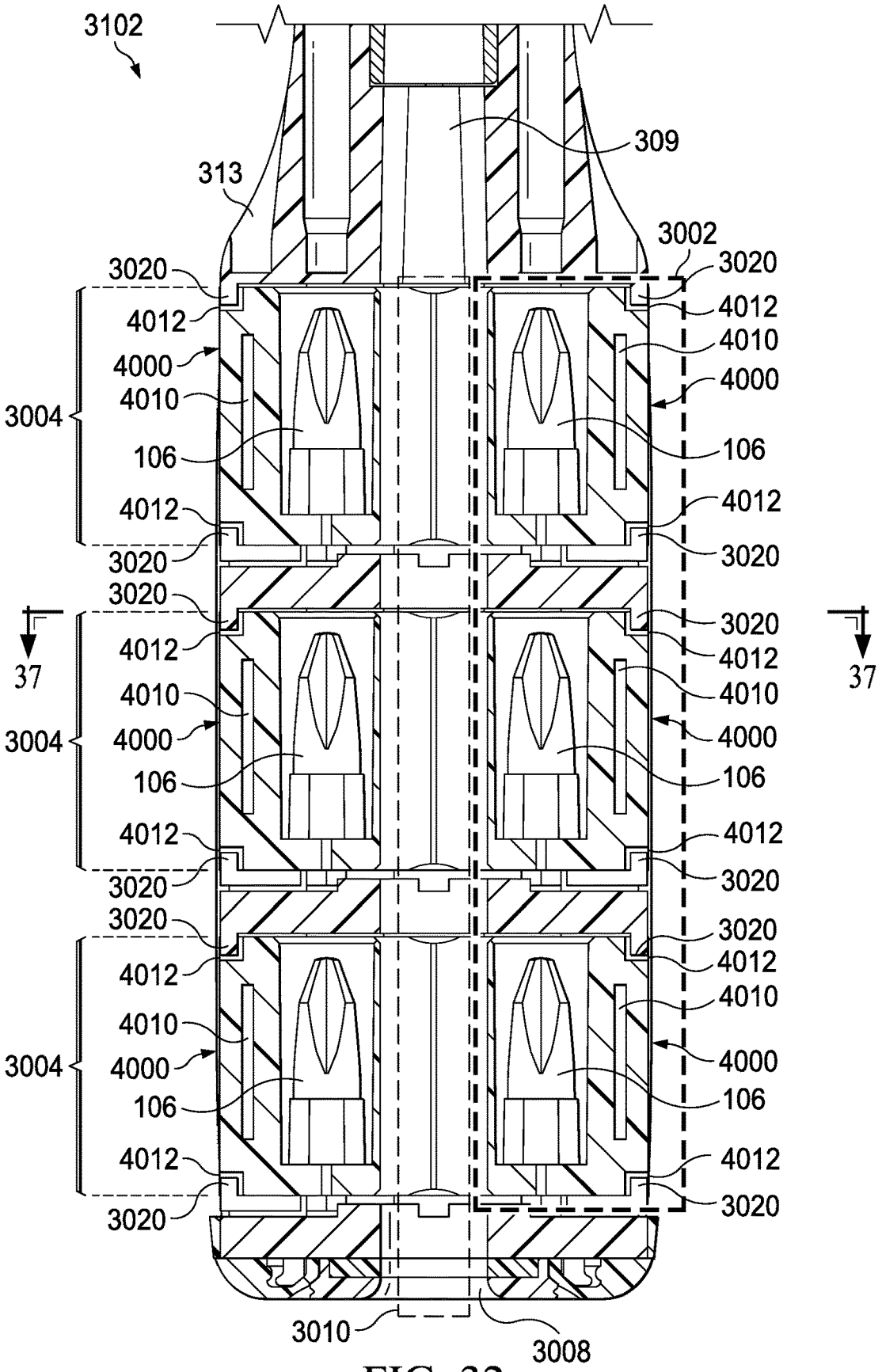
FIG. 32 is a cross-section of the screwdriver of the invention of FIG. 31 with cartridges.
Figure 33:
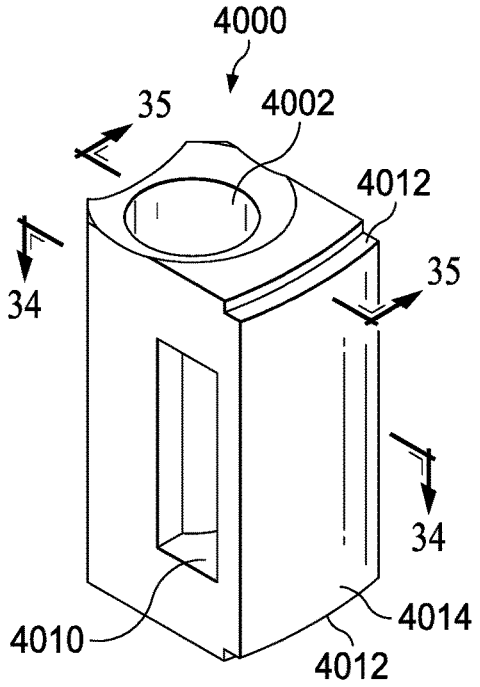
FIGS. 33-36 exemplify various views of an alternate embodiment of a cartridge adapted for holding a bit for use in a screwdriver of the invention.

The alternate embodiment of the invention as depicted by FIGS. 31 and 32 correspond to and are similar to the embodiment of the invention depicted by FIGS. 3A and 3D, but for cartridge 308 and magnets 314, 316, 406, 408, and 410 being replaced by cartridge 4000 configured for cooperating with a spring mechanism described below with respect to FIGS. 33-38D.

Figure 34:
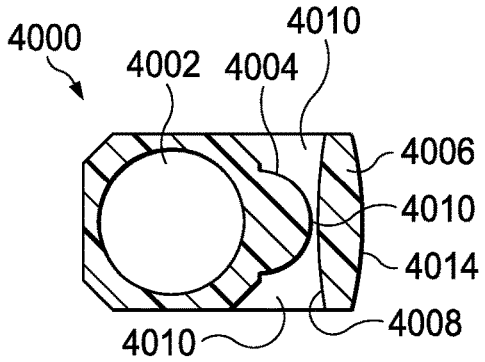
Figure 35:
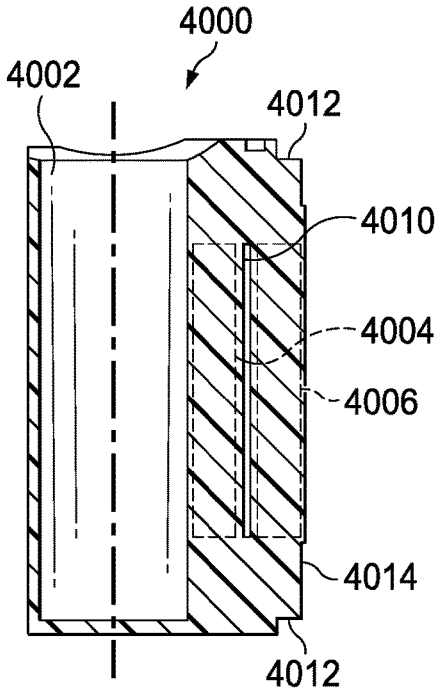
Figure 36:
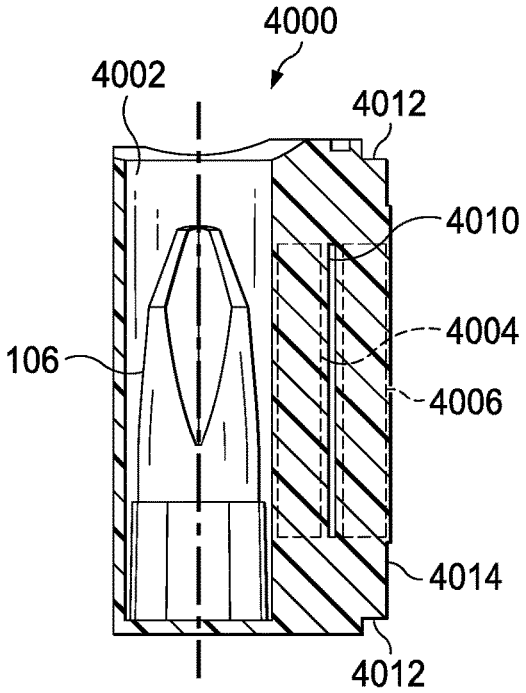

As depicted by FIGS. 33-36, a cartridge 4000 defines a cavity 4002, a slot 4010, grooves 4012, and button 4014. As shown by FIGS. 34-36, slot 4010 extends through the cartridge and between cartridge portions 4004 and 4006. As shown most clearly by FIG. 36, cavity 4002 is effective for receiving and storing bit 106. Grooves 4012 are configured to matingly engage flanges 3020 (FIG. 32), which flanges are configured to prevent cartridges 4000 from falling out of handle 3102.

Figure 37A:
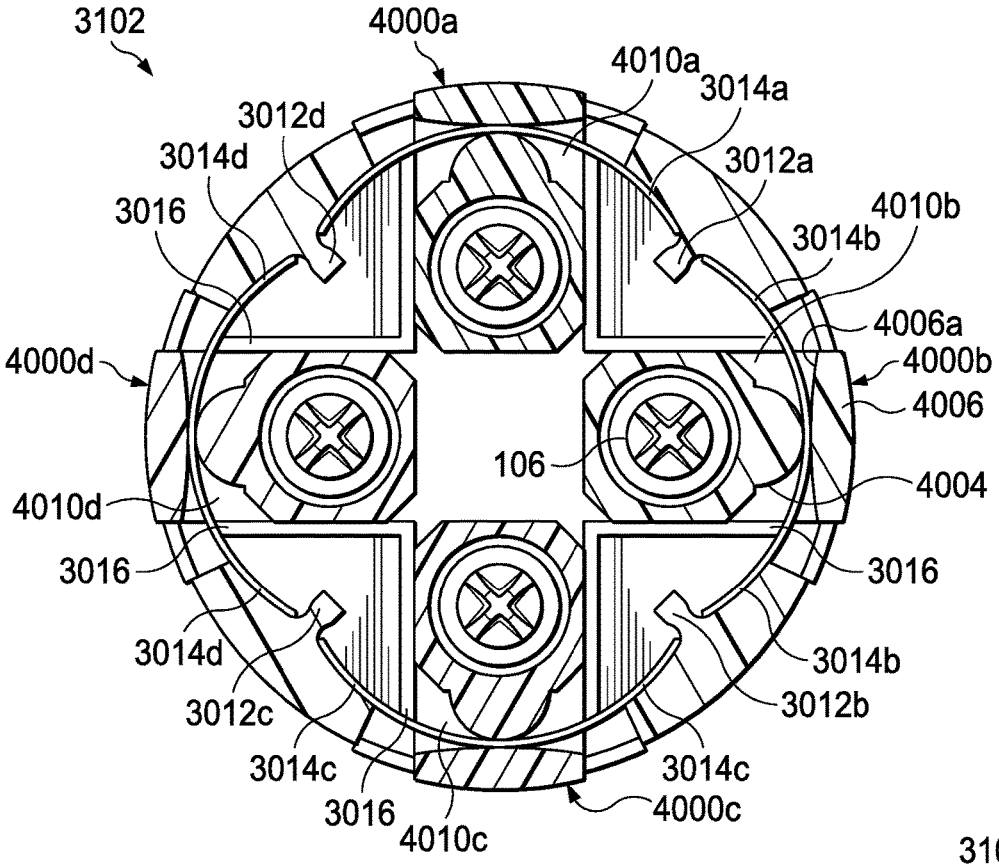
FIGS. 37A-37D, taken along line 37-37 of FIG. 32, exemplify a sequence of states of the cartridges of FIGS. 33-36 for positioning a selected bit for use.

FIGS. 37A-37D are taken along line 37-37 of FIG. 32, and exemplify a sequence of states of the cartridges of FIGS. 33-36 for positioning a selected bit for use, from four bits depicted in each of FIGS. 37A-38D. As shown in FIG. 37A, four cartridges 4000*a*, 4000*b*, 4000*c*, and 4000*d* (also referred to collectively as cartridges 4000) are slidably positioned within respective cartridge guides 3016. Spring stops 3012*a*, 3012*b*, 3012*c*, and 3012*d* (referred to collectively as spring stops 3012) extend inwardly within handle portion 3002 between the cartridges and cartridge guides. Cartridge springs 3014*a*, 3014*b*, 3014*c*, and 3014*d* (referred to collectively as cartridge springs 3014) are positioned between respective spring stops. Each cartridge spring preferably comprises a thin strip of sheet material, such as plastic (e.g., BoPET (biaxially-oriented polyethylene terephthalate), also known as Mylar®) or metal, that is flexible without yielding. Cartridge springs 3014 are sized to pass through slot 4010 in an arcuate shape and be restrained at respective spring stops 3012.

Figure 37B:
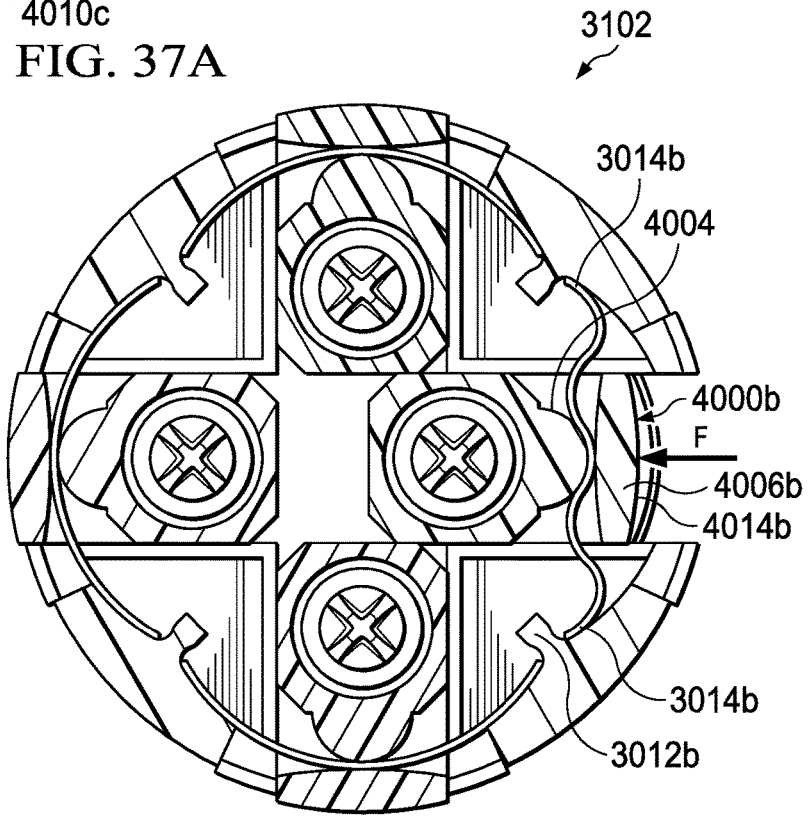
Figure 37C:
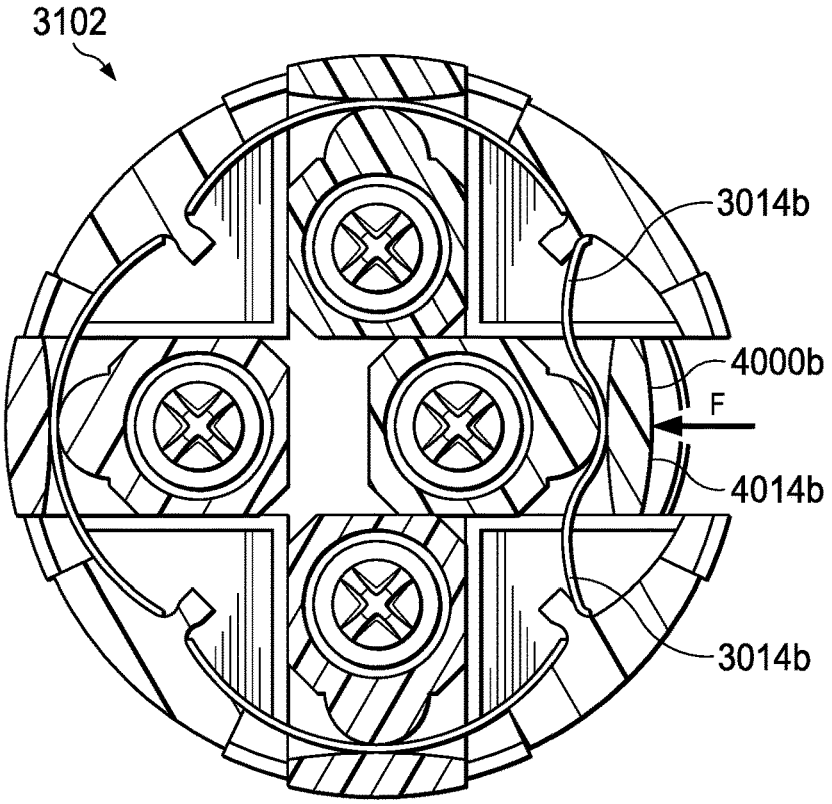
Figure 37D:
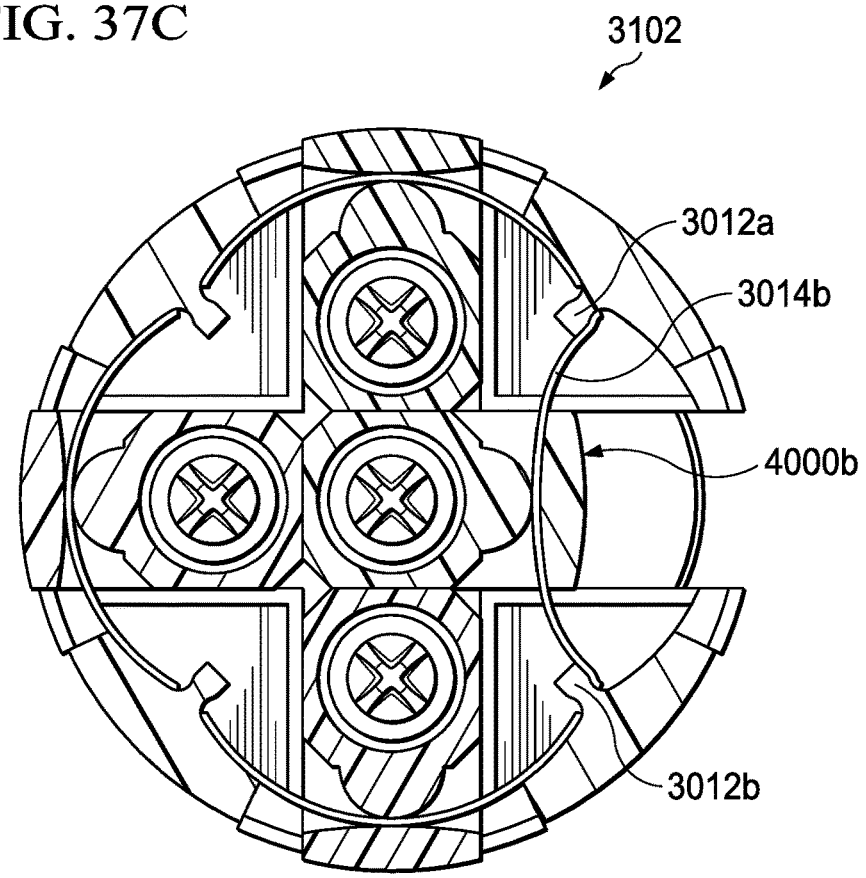

In operation, with reference to FIG. 37A, if it is desired to use a bit 106 in cartridge 4000*b*, then a user applies a force F to respective button 4014 of cartridge 4000*b* as indicated by the arrow designated with the letter F in FIG. 37B. As force is applied, cartridge 4000*b* moves leftwardly within guides 3016 of handle portion 3002, and spring 3014*b* assumes a convoluted unstable shape which initially resists the leftward movement. With continued application of force F, spring 3014*b* assumes a convoluted unstable shape which facilitates leftward movement of cartridge 4000*b*, as shown in FIG. 37C. Cartridge 4000*b* then moves, with or without the continued application of force F, toward a stable position, as depicted in FIG. 37D, wherein bit 106 is aligned with the center of barrel 320. Bit 106 may then be moved into and along barrel 320 for use as shown and described above with respect to FIGS. 9A-14B.

Figure 38A:
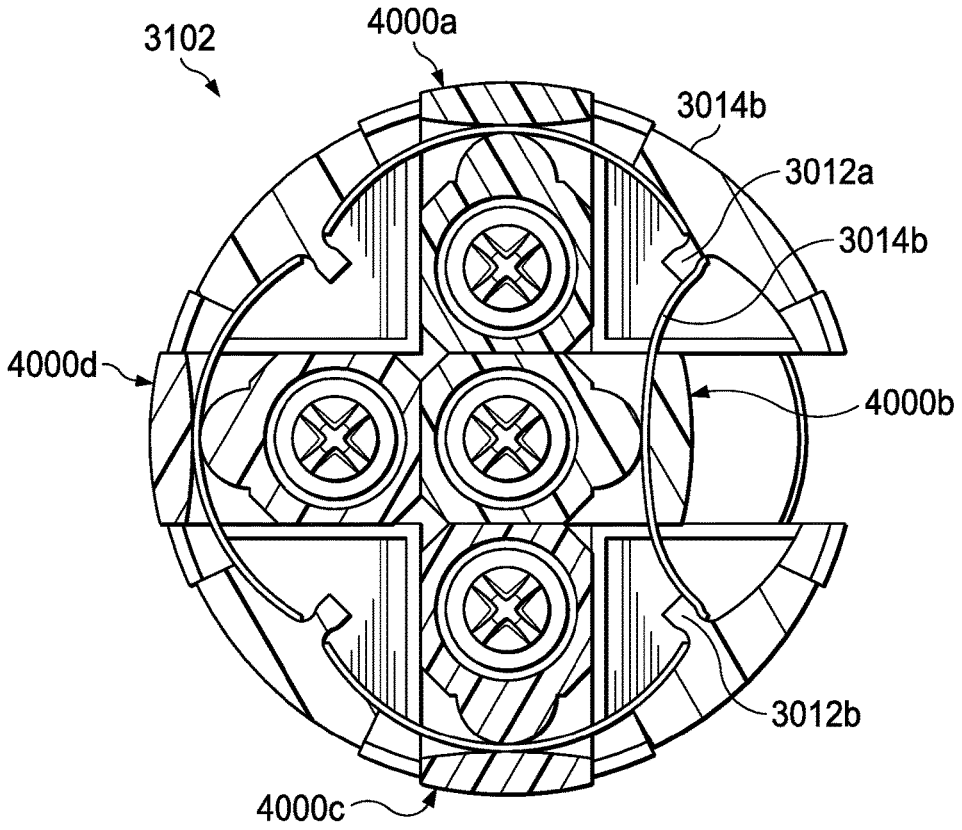
FIGS. 38A-38D, taken along line 37-37 of FIG. 32, exemplify a sequence of states of the cartridges of FIGS. 33-36 positioned in a handle for storing a bit.
Figure 38B:
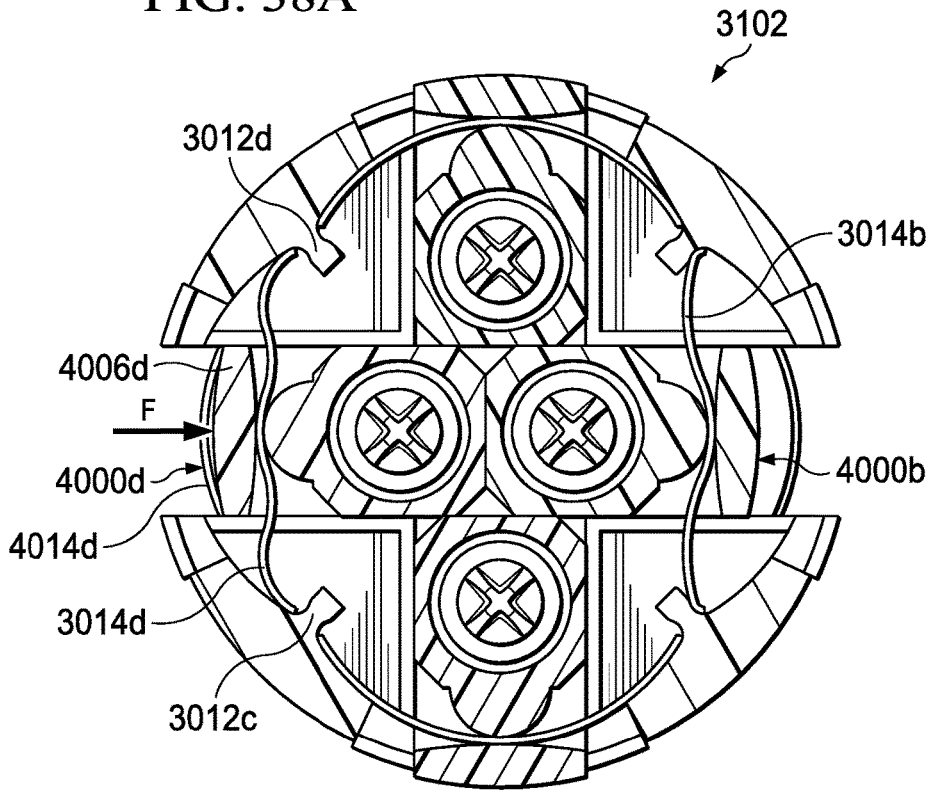
Figure 38C:
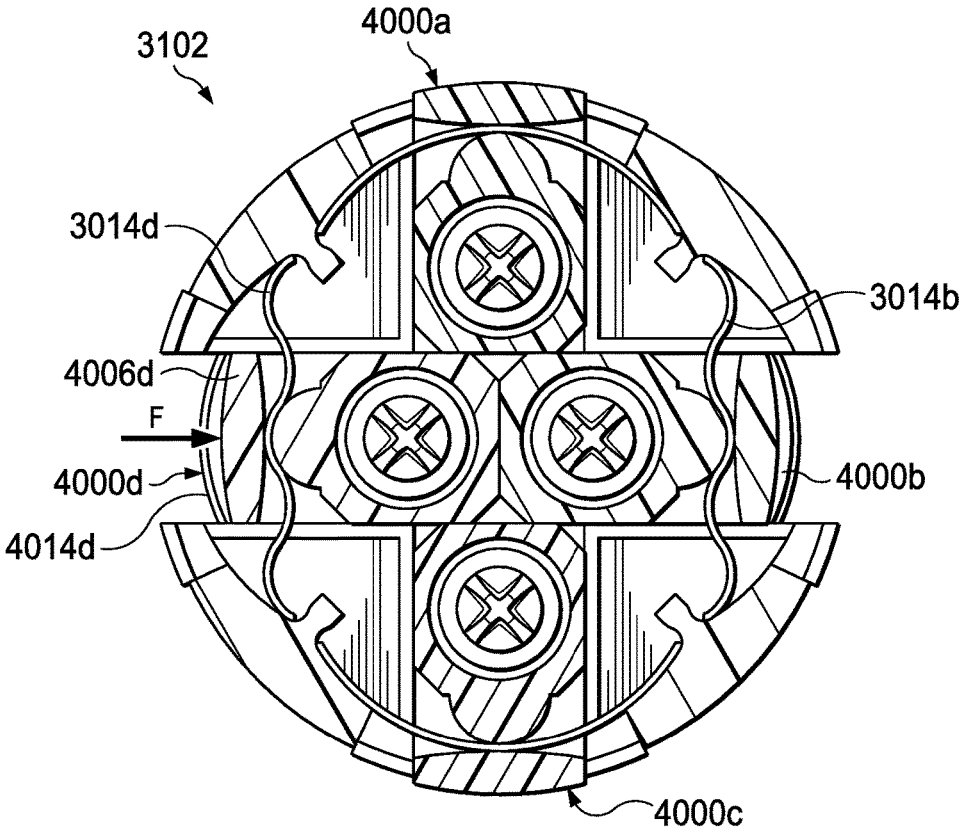
Figure 38D:
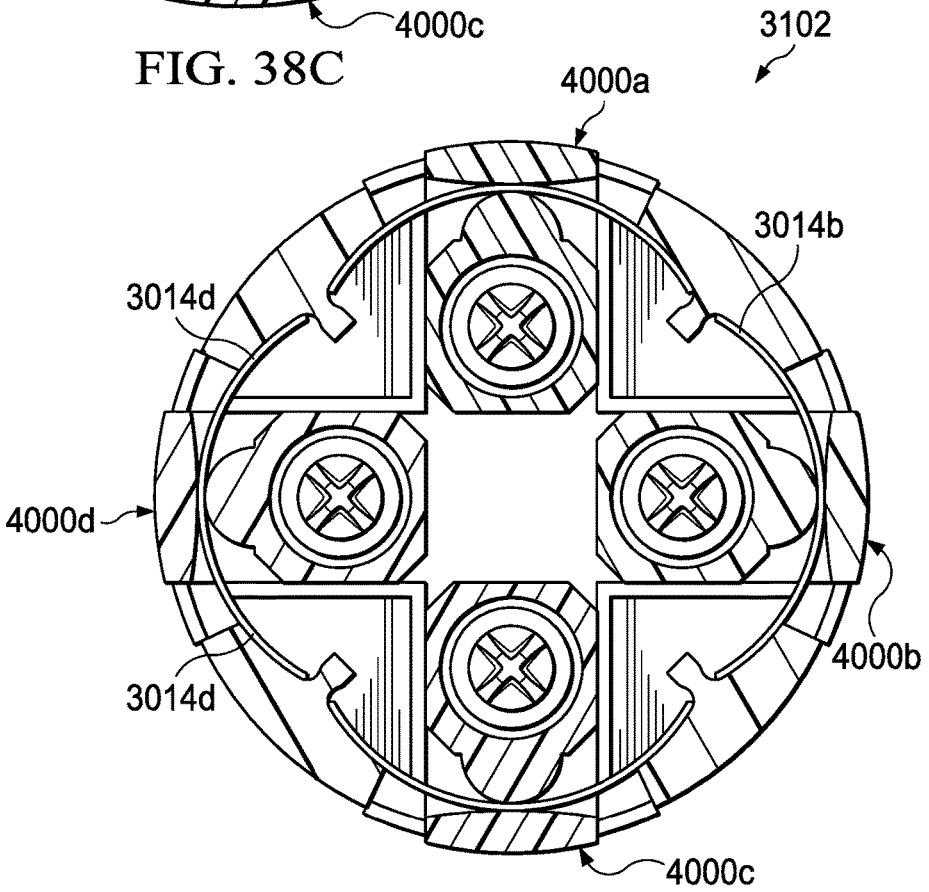

Once bit 106 is in position for use, cartridge 4000*b* may be restored to its original position shown in FIG. 37A. This is done by applying force F to button 4014*d* of opposing cartridge 4000*d*, causing cartridges 4000*d* and 4000*b* to move rightwardly, as shown in FIG. 38B. Initially, springs 3014*b* and 3014*d* assume convoluted unstable shapes which resist the movement of cartridges 4000*b* and 4000*d*. With continued application of force F, cartridges 4000*b* and 4000*d* continue to move rightwardly, and spring 3014*b* assumes a convoluted unstable shape which facilitates further rightward movement of cartridge 4000*b*, while spring 3014*d* continues to resist rightward movement of cartridge 4000*d*. Force F is then removed and springs 3014*b* and 3014*d* return cartridges 4000*b* and 4000*d* to their original positions as depicted in FIG. 37A.

When bit 106 is no longer needed or another bit is desired, bit 106 may be restored to its cartridge 4000*b*. To do that, cartridge 4000*b* is first re-positioned as shown in FIG. 37D following steps described above with respect to FIGS. 37A-37D. Bit 106 is then released from barrel 320 and allowed to fall back down into cavity 4002*b* of cartridge 4000*b*, as described above with respect to FIG. 15 and cavity 402 of a respective cartridge 308. Cartridge 4000*b* is then moved back to its original position (FIG. 38D) as described above with respect to 38A-38B.

To replace a bit 106 in a cavity 4002 of a cartridge, e.g., cartridge 4000*b* of screwdriver 3000, the bit to be removed or replaced is deployed to the "drive" position at the end of shaft 104 (FIG. 30) as discussed above with respect to FIGS. 37A-37D and 9A-14B. Cartridge 4000*b* is then positioned in a "storage" (outer perimeter) position (FIG. 38D), so that center channel 3010 is open. Screwdriver 3000 is then vertically oriented so that shaft 104 and bit 106 point upwardly. Bit 106 is then released by retracting the locking mechanism as described above with respect to FIG. 15, and the bit travels downwardly, through center channel 3010, and out through opening 3008 in the bottom cap of handle 3102. If the removed bit is to be replaced, then screwdriver 3000 is turned 180° so that it is pointing downward. The replacement bit is inserted through opening 3008 in the bottom cap of handle 3102, and it falls, via gravity, to the tip of shaft 104 (FIG. 30). Cartridge 4000*b* (or any other cartridge with an empty cavity 4002) is "pushed" so cavity 4002 is aligned with the center channel 3010. Bit 106 is then released and it falls into cartridge cavity 4002. Cartridge 4000*b* is then returned to its outer perimeter (FIG. 38D) as described above with respect to FIGS. 38A-38D.

Figure 39:
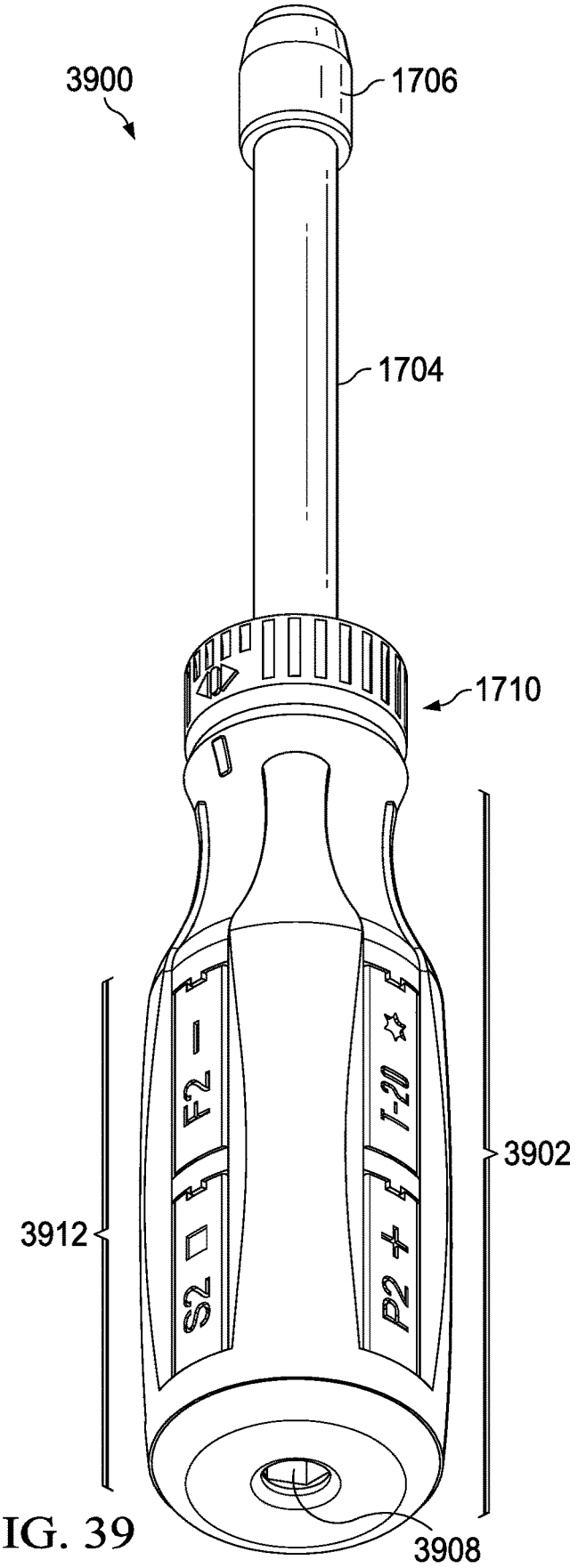
FIG. 39 is a perspective view exemplifying a screwdriver of an alternate embodiment of the invention.
Figure 40:
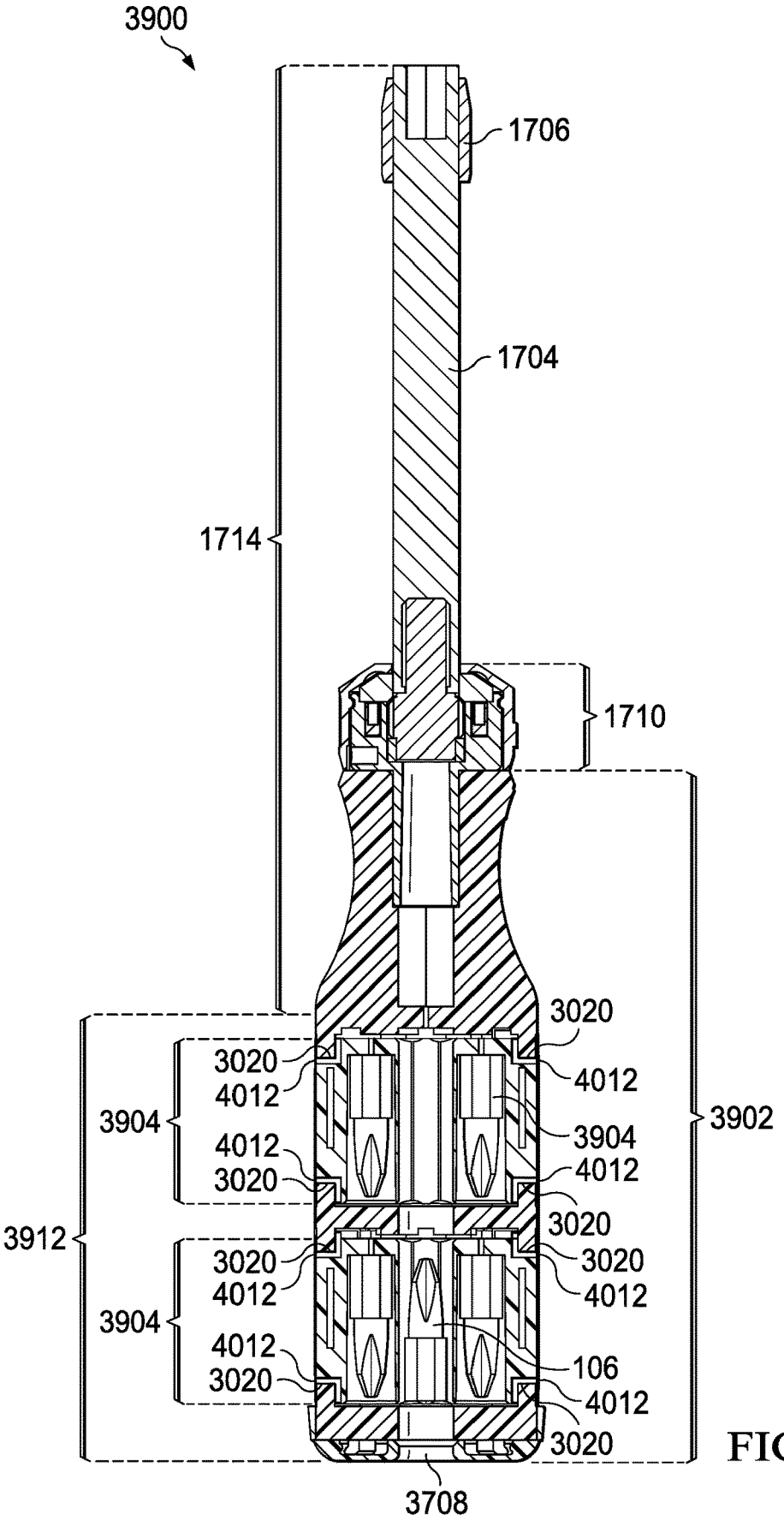
FIG. 40 is a cross-sectional view of an alternate embodiment of a screwdriver embodying features of the invention.

FIGS. 39 and 40 depict a further alternate embodiment of the invention, exemplified as a screwdriver 3900, similar in function to the embodiment of FIGS. 16-18, but, most significantly, for using springs 3014, as discussed above with respect to FIGS. 29-38D, to achieve what magnets had previously been used to achieve. Accordingly, screwdriver 3900 includes a ratchet 1710, a shaft 1704, and a driver 1706 which are substantially similar to the elements of the same respective number in FIGS. 16-18. More significantly, screwdriver 3900 includes a novel handle 3902 having cartridges 3904 which are substantially similar to cartridges 4000, but for being oriented within the screwdriver 180° from cartridges 4000. While two rows of cartridges are depicted, any number of rows (e.g., one, three) of cartridges may be configured.

As with screwdriver 1700, the portion 1714 of the screwdriver 3900 above the cartridges 3904 is configurable in any suitable manner as a conventional screwdriver, and therefore will not be discussed in further detail herein.

From a user perspective, operation of screwdriver 3900 of FIGS. 39-40 is similar to operation of screwdriver 1700 of FIGS. 16-18. The only significant operational difference is internally, wherein springs 3014, rather than magnets, are used as described above with respect to FIGS. 37A-38D.

It is understood that the present invention may take many forms and embodiments. Accordingly, several variations may be made in the foregoing without departing from the spirit or the scope of the invention. For example, someone could use similar cartridge configuration but bias them with elastic or other spring material. In another example, the function performed by the tongues 2126 and grooves 2120 for the outer cover 2112 and receiver 92 may be performed by other means, such as ball and detent. In yet another example, second grooves similar to grooves 2120 could be formed in receiver 92 for receiving tongues 2126 in the closed position of outer cover 2112. In a still further example, the function performed by magnets 314, 316, 406, 408, and 410 for biasing cartridges 308 as described above could be performed by springs

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A multi-bit screwdriver comprising:

two or more bits, each of the two or more bits defining a base portion and a head portion, the base portion defining at least one surface extending longitudinally along the base portion, the head portion being configured for engaging a fastener;

one or more cartridges, each cartridge defining a respective cavity of one or more cavities for receiving a respective bit of the two or more bits, each cartridge further defining a slot;

a handle defining two or more radially extending cells for receiving the one or more cartridges, and defining a passageway extending longitudinally along the center of the handle to an opening defined in an external surface of the handle;

two or more spring stops, each of the two or more spring stops being interposed on the handle between two adjacent cells of the two or more radially extending cells;

one or more cartridge springs, each of the one or more cartridge springs extending through a slot of a respective cartridge of the one or more cartridges and being positioned and restrained between two adjacent spring stops of the two or more spring stops, each cartridge spring of the one or more cartridge springs being sized to bow between the two spring stops and bias each of the one or more cartridges in a first position in the two or more radially extending cells wherein the cavity is not aligned with the passageway, or in a second position in the two or more radially extending cells wherein the cavity is aligned with the passageway;

a tubular shaft extending from the handle, the shaft defining a proximate end proximate to the handle and a distal end distal from the handle, the shaft including a barrel and a sleeve slidably fitted about the barrel, the barrel defining a hollow cylindrical space aligned with the passageway of the handle for facilitating sliding of a bit along the hollow cylindrical space of the barrel, the barrel including at least one land extending longitudinally along the interior of the cylindrical space, the at least one land corresponding to the at least one flat surface of the base portion of a bit, the land being narrow in cross-section at the proximate end of the shaft and continually expanding in breadth toward the distal end of the shaft;

at least one cut-out defined at the distal end of the barrel;

at least one leaf spring defining a first end and a second end, the first end being attached to the barrel;

at least one locking block attached to the second end of the leaf spring, the at least one locking block being aligned for insertion in the at least one cut-out;

a coil spring positioned between the handle and the sleeve for biasing the sleeve in a distal position away from the handle;

wherein, when the sleeve is in the distal position and a bit is positioned in the distal end of the shaft, the leaf spring biases the at least one locking block into the at least one cutout against the base portion of the bit to lock the bit in the distal end of the barrel;

and wherein, when the sleeve is moved toward the handle, away from the distal position, and a bit is positioned in the distal end of the shaft, the leaf spring allows the at least one locking block to moves away from the at least one cutout and away from the base portion of the bit.

2. The multi-bit screwdriver of claim 1 wherein each cartridge spring is fabricated from a sheet of biaxially-oriented polyethylene terephthalate.

3. The multi-bit screwdriver of claim 1 further comprising guides positioned on the handle for guiding movement of each of the one or more cartridges.

4. The multi-bit screwdriver of claim 1 wherein the one or more cartridges comprise a first cartridge and at least three second cartridges, wherein, when the first cartridge is placed in the second position, the at least three second cartridges bias the first cartridge to remain in the second position.

5. The multi-bit screwdriver of claim 1 wherein there are multiple rows of radially extending cells.

6. The multi-bit screwdriver of claim 1 wherein the two or more bits comprise at least one of an artist charcoal pencil, children's crayons, drill bits, thread cutting taps, bobbins for sewing, spices, gauge pins, screwdriver bits, and fishing weights.

7. The multi-bit screwdriver of claim 1 wherein:

the tubular shaft extends from the opening in the storage device for receiving from a cartridge cavity a selected bit of the two or more bits;

the hollow cylindrical space defines a passageway within the tubular shaft for facilitating travel of the selected bit from the opening defined in the handle to an end of the shaft opposing the opening; and a combination of the at least one locking block, leaf spring, sleeve and a lock stop form a locking mechanism for securing the selected bit at the end of the tubular shaft opposing the opening at an end of the tubular shaft.

8. The multi-bit screwdriver of claim 1 wherein each base portion defines a plurality of sides, wherein:

the tubular shaft extends from the opening in the handle for receiving from one of the one or more cavities a bit selected from the two or more bits, wherein the tubular shaft defines an interior portion having a plurality of lands corresponding in number to the plurality of sides of the base portion of the two or more bits; and a combination of the at least one locking block, leaf spring, sleeve and a lock stop form a locking mechanism for securing the selected bit at an end of the tubular shaft.

9. The multi-bit screwdriver of claim 1 wherein each base portion defines a plurality of sides, wherein:

the tubular shaft extends from the opening in the handle for receiving from one of the one or more cavities a selected bit of the two or more bits, wherein the tubular shaft defines an interior portion having a plurality of lands corresponding in number to the plurality of sides of the base portion of the two or more bits, the interior portion having an entry end, corresponding to the proximal end, proximate to the opening in the storage device, and an exit end, corresponding to the distal end, opposing the entry end, and wherein the lands are smaller at the entry end than at the exit end, and substantially conform to the shape of the base portion of the selected bit at the exit end; and a combination of the at least one locking block, leaf spring, sleeve and a lock stop form a locking mechanism for securing the selected bit at the exit end of the tubular shaft.

10. The multi-bit screwdriver of claim 1 wherein each base portion defines a plurality of sides, wherein:

the tubular shaft extends from the opening in the storage device for receiving from one of the one or more cavities a selected bit of the two or more bits, wherein the tubular shaft defines an interior portion having a plurality of lands corresponding in number to the plurality of sides of the base portion of the two or more bits, the interior portion having an entry end, corresponding to the proximal end, proximate to the opening in the storage device, and an exit end, corresponding to the distal end, opposing the entry end, and wherein the lands are smaller at the entry end than at the exit end, and substantially conform to the shape of the base portion of the selected bit at the exit end; and a combination of the at least one locking block, leaf spring, sleeve and a lock stop form a locking mechanism for securing the selected bit at the exit end of the tubular shaft.

11. The multi-bit screwdriver of claim 1 wherein each base portion defines a plurality of concave sides, the sides being conically canted toward the head portion, wherein:

the tubular shaft extends from the opening in the handle for receiving from one of the one or more cavities a selected bit of the two or more bits, wherein the tubular shaft defines an interior portion having a plurality of lands corresponding in number to the plurality of sides of the base portion of the two or more bits, the interior portion having an entry end, corresponding to the proximal end, proximate to the opening in the storage device, and an exit end, corresponding to the distal end, opposing the entry end, and wherein the lands are smaller at the entry end than at the exit end, and substantially conform to the shape of the base portion of the selected bit at the exit end; and a combination of the at least one locking block, leaf spring, sleeve and a lock stop form a locking mechanism for securing the selected bit at the exit end of the tubular shaft.

12. The multi-bit screwdriver of claim 1 wherein:

the tubular shaft extends from the opening in the handle for receiving from one of the one or more cavities a selected bit of the two or more bits;

the hollow cylindrical space defines a passageway within the tubular shaft for facilitating travel of the selected bit from the opening in the handle to an end of the shaft opposing the opening;

a combination of the at least one locking block, leaf spring, sleeve and a lock stop form a locking mechanism for securing the selected bit at the end of the tubular shaft opposing the opening at an end of the tubular shaft; and a ratchet is integrated to the multi-bit screwdriver between the handle and the tubular shaft for controlling the rotational direction in which torque is transferred between the handle and the tubular shaft.

* * * * *